US011603618B2

(12) United States Patent
Kwon et al.

(10) Patent No.: US 11,603,618 B2
(45) Date of Patent: Mar. 14, 2023

(54) GARMENT PROCESSING DEVICE AND METHOD FOR CONTROLLING SAME

(71) Applicant: LG Electronics Inc., Seoul (KR)

(72) Inventors: Oshin Kwon, Seoul (KR); Keunjoo Kim, Seoul (KR); Byunghyun Moon, Seoul (KR); Dongsoo Lee, Seoul (KR); Jaeyong Jeong, Seoul (KR); Aekyung Chae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 499 days.

(21) Appl. No.: 16/612,032

(22) PCT Filed: May 17, 2018

(86) PCT No.: PCT/KR2018/005686
§ 371 (c)(1),
(2) Date: Nov. 8, 2019

(87) PCT Pub. No.: WO2018/212614
PCT Pub. Date: Nov. 22, 2018

(65) Prior Publication Data

US 2021/0140088 A1 May 13, 2021

(30) Foreign Application Priority Data

May 17, 2017 (KR) ..... 10-2017-0060936

(51) Int. Cl.
*D06F 37/16* (2006.01)
*D06F 33/36* (2020.01)
(Continued)

(52) U.S. Cl.
CPC ..... *D06F 37/16* (2013.01); *D06F 23/04* (2013.01); *D06F 31/00* (2013.01); *D06F 33/34* (2020.02);
(Continued)

(58) Field of Classification Search
None
See application file for complete search history.

(56) References Cited

U.S. PATENT DOCUMENTS 4,467,627 A 8/1984 Platt et al.
2004/0045097 A1* 3/2004 Kim ..... D06F 35/006 68/19.2
(Continued)

FOREIGN PATENT DOCUMENTS

CN 101078176 A 11/2007
CN 101838917 A * 9/2010 ..... D06F 23/00
(Continued)

OTHER PUBLICATIONS

Chinese Office Action in Chinese Application No. 201880032497.1, dated Feb. 22, 2021 (18 pages).
(Continued)

*Primary Examiner* — Spencer E. Bell
*Assistant Examiner* — Omair Chaudhri
(74) *Attorney, Agent, or Firm* — Birch, Stewart, Kolasch & Birch, LLP

(57) ABSTRACT

Disclosed is a method of controlling a laundry treating apparatus comprising a tub configured to hold wash water, a drum mounted in the tub, a pulsator mounted in the drum, a sub-drum coupled to the drum, the sub-drum being configured to hold wash water, and a drive unit configured to rotate the drum and the pulsator. The method comprises a water current forming step comprising performing a basket motion and a pulsate motion and a cooling step comprising lowering the temperature of the drive unit. The basket motion is configured to form water current in the wash water held in the tub and in the sub-drum simultaneously. The pulsate motion is configured to form water current in wash water held in the drum while the pulsator is driven. A
(Continued)

performance timing of the cooling step is preset in at least one of the wash cycle or the rinse cycle.

15 Claims, 9 Drawing Sheets

(51) Int. Cl.

| | |
|---|---|
| ***D06F 33/44*** | (2020.01) |
| ***D06F 33/34*** | (2020.01) |
| ***D06F 31/00*** | (2006.01) |
| ***D06F 35/00*** | (2006.01) |
| ***D06F 37/40*** | (2006.01) |
| ***D06F 105/48*** | (2020.01) |
| ***D06F 105/56*** | (2020.01) |
| ***D06F 105/02*** | (2020.01) |
| ***D06F 34/06*** | (2020.01) |
| ***D06F 23/04*** | (2006.01) |
| *D06F 103/68* | (2020.01) |
| *D06F 39/08* | (2006.01) |

(52) U.S. Cl.
CPC ..... *D06F 33/36* (2020.02); *D06F 33/44* (2020.02); *D06F 34/06* (2020.02); *D06F 35/006* (2013.01); *D06F 37/40* (2013.01); *D06F 39/088* (2013.01); *D06F 2103/68* (2020.02); *D06F 2105/02* (2020.02); *D06F 2105/48* (2020.02); *D06F 2105/56* (2020.02)

(56) References Cited

U.S. PATENT DOCUMENTS

| | | | | |
|---|---|---|---|---|
| 2006/0087263 | A1* | 4/2006 | Sa | D06F 34/08 318/66 |
| 2010/0325815 | A1* | 12/2010 | Im | D06F 33/34 8/159 |
| 2011/0131734 | A1* | 6/2011 | Kim | D06F 35/006 8/137 |
| 2012/0060301 | A1* | 3/2012 | Kim | D06F 33/32 8/137 |
| 2014/0033444 | A1* | 2/2014 | Zhang | D06F 39/088 68/131 |
| 2014/0033449 | A1* | 2/2014 | Im | D06B 1/08 8/137 |
| 2016/0053422 | A1* | 2/2016 | Im | D06F 33/34 68/12.05 |
| 2016/0201245 | A1* | 7/2016 | Didat | D06F 37/304 68/12.16 |
| 2018/0066389 | A1* | 3/2018 | Wu | D06F 33/36 |
| 2019/0360142 | A1* | 11/2019 | Woo | D06F 37/40 |

FOREIGN PATENT DOCUMENTS

| | | | | | |
|---|---|---|---|---|---|
| CN | 101935931 | A | | 1/2011 | |
| CN | 104278480 | A | | 1/2015 | |
| CN | 104278485 | A | | 1/2015 | |
| CN | 105442244 | A | | 3/2016 | |
| EP | 1702096 | B2 | * | 12/2010 | D06F 37/304 |
| JP | 2014-054276 | A | | 3/2014 | |
| KR | 10-1998-0039510 | | | 8/1998 | |
| KR | 19980039510 | A | * | 8/1998 | |
| KR | 10-2003-0045447 | | | 6/2003 | |
| KR | 20030045447 | A | * | 6/2003 | |
| KR | 20030049724 | A | * | 6/2003 | |
| KR | 20110089988 | A | * | 8/2011 | |
| KR | 10-2013-0048453 | | | 5/2013 | |
| KR | 20130048453 | A | * | 5/2013 | |
| KR | 20150041855 | A | * | 4/2015 | |
| KR | 10-2016-0127676 | | | 4/2018 | |

OTHER PUBLICATIONS

Chang et al., "Maintenance Worker for Household Appliance Products," published by China Labor and Social Security Publishing House, 2002 (4 pages).

International Search Report received from the Korean Intellectual Property Office (KIPO) in PCT Application No. PCT/KR2018/005686, dated Dec. 24, 2018 (14 pages).

Office Action received from the Korean Intellectual Property Office (KIPO) in Korean Patent Application No. 10-2017-0060936, dated Feb. 17, 2018 (7 pages).

* cited by examiner

GARMENT PROCESSING DEVICE AND METHOD FOR CONTROLLING SAME

CROSS-REFERENCE TO RELATED APPLICATIONS

This application is the U.S. national phase entry under 35 U.S.C. § 371 from PCT International Application No. PCT/KR2018/005686, filed on May 17, 2018, which claims the benefit of priority under 35 U.S.C. § 119(a) to Korean Patent Application No. 10-2017-0060936, filed on May 17, 2017, the contents of all of which are incorporated herein by reference in their entireties.

TECHNICAL FIELD

Embodiments of the present disclosure relate to a laundry treating apparatus and a control method of the same, more particularly, to a laundry treating apparatus which comprises a sub-drum additionally mounted in a drum so as to perform laundry-treating in both of the drum and sub-drum.

BACKGROUND

Generally, a laundry treating apparatus comprises a washer configured to perform washing, a dryer configured to perform drying and a laundry machine with washing and drying functions configured to perform both washing and drying.

Such a laundry treating apparatus is used as the washer may comprise a cabinet defining an external appearance; a tub mounted in the cabinet and configured to hold wash water; a drum rotatably provided in the tub and configured to wash clothes or laundry; and a door coupled to the door and provided to facilitate the loading and unloading of the clothes or laundry.

The laundry treating apparatus may be classified into a top loading type having a drum shaft which vertically stands with respect to the ground and a front loading type having the drum shaft which is horizontally arranged in parallel with the ground.

In the front type laundry treating apparatus, the drum shaft is substantially parallel with the ground, the washing is performed by using a frictional force between the laundry, and the drum is rotated by the drive force of a motor and the drop impact of the laundry, in a state where detergent, wash water and laundry are loaded in the drum. Such drum washing method does little damage to the laundry and causes little laundry entangling, while having a washing effect like hand-rubbing-and-striking.

In the top loading type laundry apparatus, the drum shaft is substantially vertical with respect to the ground and the drum is mounted in the tub where wash water is held. The washing is performed in a state where the laundry is submerged in the wash water supplied to the drum, and the top loading drum laundry apparatus is categorized into a pulsator type and an agitator type. The pulsator type comprises a pulsator which is rotatably oriented in a bottom of the drum configured to accommodate wash water and laundry and rotates the wash water and the laundry by rotating the pulsator so as to perform the washing. The agitator type comprises an agitator which is projected from the bottom of the drum upwardly and rotates the wash water and the laundry by rotating the agitator so as to perform the washing.

The top loading type laundry treating apparatus is configured to perform the washing by using both the friction between the wash water and the laundry and the chemical action of the detergent which are facilitated by the rotation of the drum, the agitator, or the pulsator which is provided in the bottom of the drum to create water currents. Accordingly, wash water has to be sufficiently supplied to submerge the laundry to perform the washing in the top loading type laundry treating apparatus, and the top loading type laundry treating apparatus requires a large amount of wash water.

In the conventional laundry treating apparatus, a washing course, more specifically, the washing course, comprising a wash cycle, a rinse cycle and a dry-spin cycle, may be performed in one drum. If the laundry has to be sorted based on fabric materials, the washing course has to be performed at least two times and more operations of the laundry treating apparatus have to be performed. Accordingly, the conventional laundry treating apparatus has some disadvantages, including detergent waste and energy consumption.

To solve such disadvantages, a laundry treating apparatus further comprising a sub-drum detachably mounted in the drum is suggested. Such a sub-drum may accommodate water, independent from the tub, and water currents may be formed in the sub-drum by the rotation of the sub-drum so as to perform an additional washing course independently.

However, such sub-drum has a small capacity and it is difficult to mount the additional mechanism for generating a vortex (e.g., the pulsator mounted in the conventional drum) in the sub-drum. In addition, the occurrence frequency of the vortex by the rotation of the sub-drum is lower than that of the vortex by the rotation of the drum. Accordingly, the sub-drum has a further disadvantage of insufficient washing performance.

Moreover, the drum has to be rotated to rotate the sub-drum connected with the drum so as to perform the wash cycle or the rinse cycle after wash water is supplied to the tub and the sub-drum. In this instance, the friction between an inner surface of the sub-drum and the wash water held in the sub-drum additionally occurs as well as the friction between the wash water held in the drum and the wash water held in the tub when the drum is rotated to rotate the sub-drum after wash water is supplied to the drum and the tub. Accordingly, the force, which is as strong as the weight of the wash water held in the sub-drum and the laundry, is additionally applied to the drum, and more load is applied to the motor to rotate the drum enough to raise the temperature of the motor drastically.

Also, the laundry held in both the drum and the sub-drum has to be washed effectively while energy consumption is reduced. However, in case of washing the laundry held in the drum and the sub-drum, using one motor, it is difficult to effectively wash the laundry held in the drum and the laundry held in the sub-drum, while reducing the duration of the washing course and the energy consumption. Accordingly, it becomes necessary to provide a new laundry treating apparatus which may wash both the laundry held in the drum and the laundry held in the sub-drum effectively, while reducing the duration of the washing course and the energy consumption simultaneously, and a control method thereof.

DETAILED DESCRIPTION

Technical Problem

To overcome the disadvantages, an object of the present disclosure is to provide a laundry treating apparatus which may prevent the drastic rise of the temperature in a motor which might be caused by overload when a drum and a sub-drum are rotated simultaneously when wash water is supplied to a tub and a sub-drum, and a control method of the same.

Furthermore, another object of the present disclosure is to provide a laundry treating apparatus which may wash the laundry held in the drum and the sub-drum effectively, while preventing the rise of the temperature inside the motor, and a control method of the same.

Still further, a further object of the present disclosure is to provide a laundry treating apparatus which may prevent the overload or overheating of the motor and then to minimize the increase of the overall washing time, and a control method of the same.

Still further, a still further object of the present disclosure is to provide a laundry treating apparatus which may preset a performance order and pattern between operation conditions of the motor so as to solve the overheating of the motor and to cause the motor to be operated based on the preset order or pattern, and a control method of the same. Accordingly, the laundry treating apparatus is capable of washing all of the laundry held in both the drum and the sub-drum in an optimal washing time.

Still further, a still further object of the present disclosure is to provide a laundry treating apparatus which may realize a simple control logic for minimizing the increase of the time taken to treat laundry, regardless of the washing, by omitting or minimizing the process implemented to monitor the overheating of the motor repeatedly or consistently during the washing operation, and a control method of the same.

Technical Solution

To achieve these objects and other advantages and in accordance with the purpose of the embodiments, as embodied and broadly described herein, a method of controlling a laundry treating apparatus is provided, the laundry treating apparatus comprising a tub configured to hold wash water, a drum rotatably mounted in the tub, a pulsator rotatably mounted in the drum, a sub-drum detachably coupled to an inner circumferential surface of the drum, the sub-drum being configured to hold wash water, and a drive unit configured to rotate the drum and the pulsator. The method comprises a water current forming step comprising performing a basket motion and a pulsate motion to perform a wash cycle and a rinse cycle and a cooling step comprising lowering the temperature of the drive unit. The basket motion is configured to form water current in the wash water held in the tub and the wash water held in the sub-drum simultaneously, as the drum and the sub-drum are driven together, and the pulsate motion is configured to form water current in wash water held in the drum while the pulsator is driven. A performance timing of the cooling step is preset in at least one of the wash cycle or the rinse cycle.

In the pulsate motion, the drum and the sub-drum may not be rotated and only the pulsator may be driven. Compared to a load applied to the drive unit in the basket motion, less load may be applied to the drive unit in the pulsate motion.

During the wash or rinse cycle, the basket motion may be performed more than two times and the pulsate motion may be performed more than two times. The performance timings of the basket motion and the pulsate motion may be preset to be different from each other.

The basket motion may be configured to substantially wash or rinse the laundry loaded in the sub-drum and the pulsate motion may be configured to substantially wash or rinse the laundry loaded in the drum. Through the wash (or rinse) cycle, the laundry loaded in the drum and the laundry loaded in the sub-drum may be effectively washed or rinsed. The pulsate motion and the basket motion applying load to the drive unit may be dispersed throughout the entire sections of the wash (rinse) cycle to prevent overloading the drive unit. Especially, the basket motion applying a maximum load to the drive unit may be dispersed to prevent overloading the drive unit more effectively.

The method may comprise a water current forming step comprising performing the basket motion and the pulsate motion and a cooling step comprising lowering the temperature of the drive unit.

As one example, the cooling step may be performed as soon as the basket motion and the pulsate motion are dispersed such that overloading of the drive unit may be prevented more effectively. Especially, overloading may be shut off in advance so as to prevent the unnecessary increase of the wash or rinse cycle time caused by the overload.

A performance timing of the cooling step may be preset in the wash cycle or the rinse cycle such that the control logic can become simple and that the increase of the washing time can be prevented. The washing may end without large change of the total washing time which is determined in an initial stage by solving the overload of the drive unit.

The preset of the cooling step performance timing may mean that the performance timing of the cooling step is preset by default, not necessarily that it is selectively performed on the entire wash or rinse algorithm. In other words, the cooling step performance timing may be set between the basket motion and the pulsate motion configured to perform the water current forming step by default, before the cooling step is performed.

The cooling step may be performed after an initial basket motion, because the largest load is generated in the basket motion.

It may be preset to perform the cooling step after performing the basket motion and the pulsate motion serially or after performing the pulsate motion and the basket motion serially.

In the cooling step, the drive unit may be controlled with less load than a load in the basket motion and the pulsate motion. Accordingly, the raised temperature of the drive unit may be lowered.

In the water current forming step, a total duration time of the pulsate motion may be longer than a total duration time of the basket motion. That is considering the difference between the load applied in the pulsate motion and the load applied in the basket motion the difference between the amount of the laundry loaded for the wash or rinse cycle. In other words, when it is assumed that the sub-drum having a smaller capacity is coupled to the drum, it may be obvious that the laundry loaded in the drum is larger than the laundry loaded in the sub-drum.

A performance time of the water current forming step may be longer than a performance time of the cooling step. Performing the cooling step for too long might increase the duration time of the wash or rinse cycle unnecessarily. In contrast, it will not guarantee sufficient time for the wash or rinse cycle.

In the water current forming step, a performance frequency of the basket motion may be larger than a performance frequency of the pulsate motion. In the water current forming step, a maximum duration time of the basket time may be equal to or smaller than a maximum duration time of the pulsate motion, considering the difference between the load applied in the pulsate motion and the basket motion and to guarantee sufficient time for the wash or rinse cycle for the laundry loaded in the sub-drum.

The cooling step may comprise a water supply step comprising determining whether to supply additional wash water to the tub and selectively supplying the additional wash water.

The control method may further comprise stopping a rotation of the drum and the pulsator in the water supply step. For the effective washing or rinsing, the optimal amount of the wash water may need to be supplied and the additional water supply may be necessary. Accordingly, overheating of the drive unit may be prevented by using the water supply step effectively.

The water supply step may be performed between the basket motion and the pulsate motion, between the basket motion and the basket motion, or between the pulsate motion and the pulsate motion. In other words, overheating of the drive unit may be effectively prevented by performing the water supply step between the motions which apply relatively large amounts of load.

The method may further comprise controlling the rotation of the drum to move the sub-drum to a preset location in the water supply step. In other words, when the drum has to be rotated to the preset location to supply wash water to the drum, the additional water supply may be performed after such the angle control motion is performed.

The cooling step may further comprise a laundry disentangling step comprising performing a balance motion to repeatedly rotate the pulsator in a clockwise and counterclockwise direction to disperse laundry in the drum uniformly.

The cooling step may further comprise a pause step comprising stopping a rotation of the drum and the pulsator and repeatedly rotating the drum in a clockwise and counterclockwise direction at a lower rpm than an rpm of the drum in the basket motion.

The balance motion, the stop motion and the low speed rotation motion may apply a relatively small load to the drive unit. Accordingly, the performance timings of such motions may be preset to prevent overheating of the drive unit. Also, the prevention of the overheating and the effective washing or rinsing may be facilitated by the motions.

The laundry disentangling step may be performed between the pulsate motion and the pause step, because it may be more likely for the pulsate motion to generate the laundry entangling.

The pause step may be performed between the basket motion and the pulsate motion. It may be preferred that stopping a rotation of the drum and the pulsator and repeatedly rotating the drum at a lower rpm, which generates the smallest load, be performed between the basket motion and the pulsate motion, because the basket motion generates the largest load.

The wash cycle may be divided into an initial washing cycle and a latter washing cycle. A timing of the initial washing cycle and a timing of the latter washing cycle may be relative to a time at which the wash water is supplied to the tub. In other words, the washing stage before the final water supply may be the initial washing cycle and the washing stage after the final water supply may be the latter washing cycle.

It may be preferred that the laundry disentangling step is performed in the latter washing cycle. For the cooling after the final water supply, the laundry disentangling step may be performed.

A frequency and a performance time of the basket motion performed in the initial washing cycle may be larger than a frequency and a performance time of the basket motion performed in the latter washing cycle. The additional supply of the wash water may be performed only in the tub, not in the sub-drum. The additional water supply may be omitted in case of the small amount of the laundry such that no more wash water may be supplied to the sub-drum after the initial water supply in the wash or rinse cycle. In the initial water supply, it can be said that a sufficient or proper amount of wash water is supplied such that it may be possible to wash the laundry loaded in the sub-drum from the initial stage of the washing.

In terms of the washing for the laundry loaded in the sub-drum, it may be preferred that the washing is intensively performed for the laundry loaded in the sub-drum in the initial washing cycle, compared with the latter washing cycle.

The basket motion may be performed serially after the pulsate motion is performed. The temperature of the drive unit raised in the pulsate motion might rise even in the basket motion.

The pulsate motion may be performed serially after the basket motion, and the cooling step may be preset to be performed after the pulsate motion. Accordingly, even when the basket motion and the pulsate motion are performed for the washing or rinsing serially, the temperature of the drive unit may be lowered by the cooling step performed by default.

The control method may further comprise completing the water current forming step by a final performance of the basket motion, and driving a drainage pump to perform drainage while stopping the drum and the pulsator from being driven. The basket motion applying the largest load to the drive unit may be performed right before the drainage and dry-spinning and it may be possible to cool the drive unit during the drainage and dry-spinning. Accordingly, the basket motion of which the frequency may be limited because of the concern about the drive unit overheat may be performed so as to satisfy the sub-drum washing or rinsing effect.

Embodiments of the present disclosure also provide a method of controlling a laundry treating apparatus comprising, a tub configured to hold wash water, a drum rotatably mounted in the tub, a pulsator rotatably mounted in the drum, a sub-drum detachably coupled to an inner circumferential surface of the drum and configured to hold wash water, and a drive unit configured to rotate the drum and the pulsator. The method may comprise a water current forming step comprising performing a basket motion and a pulsate motion to perform a wash cycle and a rinse cycle, as the basket motion and the pulsate motion are repeated and a cooling step performed during the wash or rinse cycle and after the water current forming step starts. The basket motion is configured to form water current in the wash water held in the tub and the wash water held in the sub-drum simultaneously, as the drum and the sub-drum are driven together. The pulsate motion may be configured to form water current in wash water held in the drum while the pulsator is driven. The cooling step comprises lowering the temperature of the drive unit. The cooling step may be configured to operate with an output that is smaller than a reference applied to the drive unit. The performance timing of the cooling step may be present in the wash or rinse cycle.

A performance timing of the cooling step may be preset.

In the water current forming step, a total duration time of the pulsate motion may be longer than a total duration time of the basket motion.

The cooling step may comprise a water supply step comprising stopping a rotation of the drum and the pulsator when additional wash water is supplied to the drum.

The water supply step may be performed between the basket motion and the pulsate motion.

The water supply step may be performed between the basket motion and the basket motion.

The water supply step may be performed between the pulsate motion and the pulsate motion.

When the water supply is needed to wash the laundry loaded in the drum effectively, overloading of the drive unit may be prevented by the additional water supply. As the expected or expectable additional is used, the unnecessary increase of the washing time may be prevented so as to prevent the overloading of the drive unit.

A method of controlling a laundry treating apparatus comprising a tub configured to hold wash water, a drum rotatably mounted in the tub, a pulsator rotatably mounted in the drum, a sub-drum detachably coupled to an inner circumferential surface of the drum and configured to hold wash water, and a drive unit configured to rotate the drum and the pulsator is provided. A wash cycle and a rinse cycle are performed by performing a basket motion and a pulsate motion, and the basket motion is configured to form water current in the wash water held in the tub and the wash water held in the sub-drum simultaneously, as the drum and the sub-drum are driven together. The pulsate motion is configured to form water current in wash water held in the drum as the pulsator is driven. The method comprises a first water current forming step configured to perform the basket motion so as to perform the wash or rinse cycle, and a second water current forming step configured to perform the pulsate motion to as to perform the wash or rinse cycle. The first water current forming step and the second water current forming step are performed during the wash or rinse cycle more than two times.

The first water current forming step and the second water current forming step may be performed in the entire wash or rinse cycle uniformly and dispersedly. To suppress the temperature increase of the drive unit caused by the basket motion, the maximum performance time of one basket motion may be equal to or shorter than the maximum performance time of one pulsate motion.

Further scope of applicability of the present disclosure will become apparent from the detailed description given hereinafter. However, it should be understood that the detailed description and specific examples, while indicating preferred embodiments of the present disclosure, are given by illustration only, since various changes and modifications within the spirit and scope of the invention will become apparent to those skilled in the art from this detailed description.

Advantageous Effects

The embodiments have following advantageous effects. According to the embodiments of the present disclosure, the laundry treating apparatus and a control method of the same may be capable of preventing the drastic rise of the temperature in a motor which might be caused by overload when a drum and a sub-drum are rotated simultaneously when wash water is supplied to a tub and a sub-drum.

Furthermore, the laundry treating apparatus and a control method of the same may be capable of washing the laundry held in the drum and the sub-drum effectively, while preventing a rise of the temperature inside the motor.

Still further, the laundry treating apparatus and a control method of the same may be capable of preventing the overload or overheating of the motor and minimizing the increase of the overall washing time.

Still further, the laundry treating apparatus and a control method of the same may be capable of presetting a performance order and pattern between operation conditions of the motor so as to solve the overheating of the motor and cause the motor to be operated based on the preset order or pattern. Accordingly, the laundry treating apparatus may be capable of washing all of the laundry held in both the drum and the sub-drum in an optimal washing time.

Still further, the laundry treating apparatus and a control method of the same may be capable of realizing a simple control logic for minimizing the increase of the time taken to treat laundry, regardless of the washing, by omitting or minimizing the process implemented to monitor the overheating of the motor repeatedly or consistently during the washing operation.

Still further, the laundry treating apparatus may be capable of preventing the overheating of the motor and performing the effective washing by differentiating the implementation frequency of a basket motion and a pulsate motion in the wash or rinse cycle.

Still further, the laundry treating apparatus may be capable of preventing the overheating of the motor and performing the effective washing by differentiating the maximum duration time of one basket motion and the maximum duration time of the pulsate motion from each other in the wash or rinse cycle.

Still further, the laundry treating apparatus may be capable of preventing the overheating of the motor and performing the effective washing by differentiating the total duration time of the basket motions and the total duration time of the pulsate motions.

Still further, the laundry treating apparatus may be capable of preventing the overload of the drive unit by implementing the additional water supply to the tub between the basket motions.

DESCRIPTION OF SPECIFIC EMBODIMENTS

Referring to the accompanying drawings, exemplary embodiments of the present disclosure according to an embodiment of the present disclosure will be described in detail. Regardless of numeral references, the same or equivalent components may be provided with the same reference numbers and description thereof will not be repeated. For the sake of brief description with reference to the drawings, the sizes and profiles of the elements illustrated in the accompanying drawings may be exaggerated or reduced and it should be understood that the embodiments presented herein are not limited by the accompanying drawings.

Figure 1:
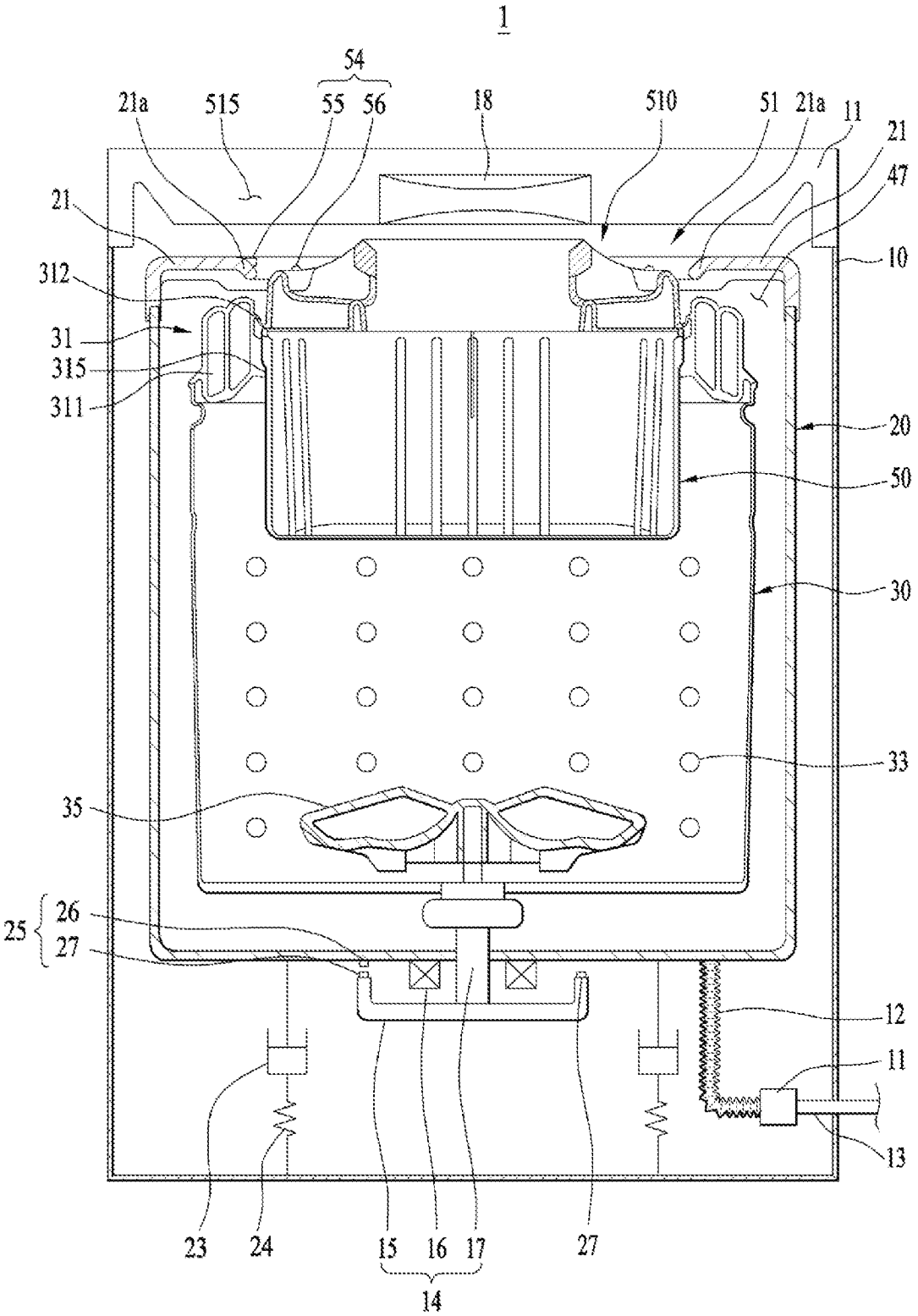
FIG. 1 is a schematic diagram illustrating a structure of a laundry treating apparatus in accordance with an embodiment of the present disclosure.

FIG. 1 is a schematic diagram illustrating a structure of a laundry treating apparatus in accordance with an embodiment of the present disclosure;

Referring to FIG. 1, the laundry treating apparatus 1 in accordance with an embodiment may comprise a cabinet 10 having an opening formed in an upper portion to load clothes or laundry (hereinafter, the laundry), a door (not shown) coupled to the opening to open and close the opening, a tub 20 mounted in the cabinet 10 and configured to store wash water, and a drum 30 rotatably mounted in the tub 20.

The laundry treating apparatus may further comprise a drive unit 14 configured to drive the drum 30, and a pulsator 35 configured to rotate in the drum 30 so as to form water currents in the wash water supplied to the drum and the tub.

The drive unit 14 may be provided to selectively rotate the drum 30 and the pulsator 35.

Meanwhile, the laundry treating apparatus in accordance with the embodiment may comprise a sub-drum 50 detachably mounted in the drum 30 and configured to perform washing, independent from the washing in the drum 30.

In the embodiments of the present disclosure, the wash water for washing the laundry and the wash water for washing the door and the like are referred to as 'the wash water' and the drum 30 is referred to as 'the main-drum'.

FIG. 1 shows a direct-type motor drive structure which directly connects the motor to a shaft 17 to drive the drum 30. However, the laundry treating apparatus 1 in accordance with the illustrated embodiment is not limited thereto.

The cabinet 10 may define the exterior appearance of the laundry treating apparatus 1 and may comprise a cabinet cover 11 having an opening to communicate the inside of the cabinet with the outside so as to load the laundry.

The cabinet cover 11 may be provided in an upper end of the cabinet 10 and the door (not shown) may be rotatably coupled to a top of the opening to selectively open and close the opening. Accordingly, a user may be able to load or unload the laundry into or from the drum 30 and the sub-drum by opening and closing the door.

Meanwhile, a water supply unit 18 may be provided in the cabinet cover 11 to supply the water mixed with detergent or clean water with no detergent to the drum 30 and the sub-drum 50. The wash water exhausted from the water supply unit 18 may be supplied to the drum 30 and/or the sub-drum 50.

The wash water exhausted from the water supply unit 18 may be supplied only to the drum 30 or only to the sub-drum 50. It may be necessary not only to separate a laundry accommodating space of the drum 30 from a laundry accommodating space of the sub-drum 50 but also to separate the wash water supplied to the drum 30 from the wash water supplied to the sub-drum 50. In other words, it may be necessary to limit the supply of the wash water supplied to the sub-drum 50 and to the drum 30 and vice versa, because a contamination level or fabric type of the laundry loaded in the drum could be different from a contamination level or fabric type of the laundry loaded in the sub-drum. Accordingly, it may also be necessary to separate the laundry and the wash water supplied to the drum from the laundry and the wash water supplied to the sub-drum.

In the illustrated embodiment, the wash water may be selectively supplied to the drum 30 or the sub-drum 50 via the inside of the tub 20 based on the rotation of the sub-drum 50. In other words, the wash water may be directly supplied to the internal space of the drum 30, not passing through the internal space of the sub-drum and the internal space of the sub-drum 50, not passing through the internal space of the drum 30. The wash water supplied to the drum 30 and the wash water supplied to the sub-drum 50 may not be mixed during the wash cycle and it may be preferred that they are not mixed in the internal space of the drum 30 and the internal space of the sub-drum 50 even during the dry-spin cycle and the water drainage process.

The tub 20 may be formed in a cylinder shape with an open top and mounted in the cabinet 10 to accommodate the wash water. The tub 20 may comprise a tub cover 21 installed to an upper end.

The tub cover 21 may be located higher than an upper end of the drum 30 and an upper end of the sub-drum 50 mounted in the drum 50. A laundry introduction opening 580 may be formed in the tub cover 21, corresponding to the opening of the cabinet 10. The laundry may be loaded into the drum or the sub-drum via the laundry introduction opening 580.

Meanwhile, the tub cover 21 may comprise a cover bent portion **21*a* provided in an inner circumferential surface of the laundry introduction opening 580 and inclined downwards to an inner area of the tub cover 21**.

The cover bent portion **21*a* may allow the wash water rising along the inner circumferential surface of the tub by the rotational force of the drum 30 to lead in the drum and fall. Such a water current of the wash water (hereinafter, "alpha water current") may facilitate the effective washing for the laundry loaded in the drum 30. However, it may be preferred that the washing process which uses the water current of the wash water is performed only in a state where the sub-drum 60 is not mounted in the drum 30, because the wash water might be mixed in this instance. When the sub-drum 50 is mounted in the drum 30 to perform the washing for both the laundry loaded in the drum 30 and the laundry loaded in the sub-drum 50**, the driving of the drive unit may be controlled not to generate such the alpha water current. If the drive unit is driven to generate the alpha water current in the state where the sub-drum is mounted in the drum, it may be more concerned about the overload of the drive unit.

A lower surface of the tub 20 may be flexibly supported by a spring 24 and a damper 23 which may be installed in the cabinet 10. As the lower surface may be directly supported by the spring 24 and the damper 23, the tub 20 may not be rotary as it is so that the tub may not be provided with an auxiliary rotational force by the drive unit 14, different from the drum 30. FIG. 1 shows that the spring 24 and the damper 23 may be serially connected to the lower surface of the tub 20, but the embodiments of the present disclosure are not limited thereto. If necessary, the spring 24 and the damper 23 may be connected to the lower surface in parallel. Alternatively, the damper 23 may be connected to the lower surface of the tub 20 and the spring 24 may be connected to an upper surface of the tub 20 and vice versa.

A drainage mechanism configured to drain water may be connected to the lower surface of the tub 20. The drainage mechanism may comprise a drainage pump 11 for providing a power to drain the wash water held in the tub 20, a first drainage pipe 12 having one end connected to the lower surface of the tub and the other end connected with the drainage pump 11 so as to guide the wash water toward the drainage pump 11, and a second drainage pipe 13 having one end connected with the drainage pump 11 and the other end connected with one side of the cabinet 10 so as to drain the wash water outside the cabinet 10 from the drainage pump 11. The first drainage pipe 12 may be a bellows pipe not to transfer the vibration of the tub 20 to the drainage pump 11.

The drive unit 14 may comprise a motor comprising a rotor 15 and a stator 16, and a shaft 17 connected with the rotor 15. As a clutch (not shown) may be provided in the drive unit 14, the drive force may be transferred to the drum 30 and the pulsator 35. For example, when the shaft 17 is selectively coupled to the drum 30 in a state of being fixed to the pulsator 35, the drive unit 14 may transfer the drive force to the pulsator 35 or both of the pulsator 35 and the drum 30. As another example, the shaft 17 may be selectively coupled to the pulsator in a state of being fixed to the drum 30 and the drive unit 14 may then transfer the drive force to the drum 30 or both of the pulsator 35 and the drum 30.

As mentioned above, the shaft 17 may be fixed to one of the pulsator 35 and the drum 30 and may be selectively coupled to the other one. However, such description may not exclude the structure configured to selectively couple the shaft only to the pulsator 35 or the drum 30.

The laundry treating apparatus 1 in accordance with an embodiment may comprise the drum 30 rotatably mounted in the tub 20 and configured to hold clothes or laundry, and the sub-drum 50 detachably mounted in the drum 30.

The drum 30 may be formed in a cylinder shape with an open top and an approximately circular cross-section and a lower surface directly connected with the shaft 17 to receive the rotational force from the drive unit 14.

The drum 30 may be formed in the cylinder shape with the open top and a plurality of through-holes may be formed in a lateral wall, in other words, a circumferential surface. The drum 30 may be in communication with the tub 20 via the plurality of the through-holes 33. Accordingly, when wash water is supplied to the tub 20 to a preset water level or more, the drum 30 may become submerged in the wash water and some of the wash water may flow into the drum via the through-holes 33.

The drum 30 may comprise a drum cover 31 provided in an upper end. The drum cover 31 may be formed in a hollow ring shape and arranged in a lower area of the tub. An outlet path 47 may be horizontally extended by the upper surface of the drum cover 31 and the lower surface of the tub cover 21. The outlet path 47 may be provided to guide the wash water exhausted outside via a lateral surface of the sub-drum 50 toward the inside of the tub 20 again.

The wash water held in the drum 30 may be drawn toward inner and lower walls of the tub via the through-holes 33 of the drum 30 and then drained. The wash water held in the sub-drum 50 may be drawn toward the inner wall of the tub via the top of the sub-drum 50. In other words, the wash water may be flowing in a side gap between the drum 30 and the tub 20 via the outlet path 47 and then to the lower wall of the tub to be drained outside. Accordingly, the wash water held in both the drum 30 and the sub-drum 50 may not be mixed with each other in the drum 30 and the sub-drum 50, when drained outside. Also, the wash water supplied to both the drum 30 and the sub-drum 50 may not be mixed with each other.

The drum cover 31 may have an opening so as to load the laundry or mount the sub-drum 50 therein. Also, the drum-cover 31 also may have a balancer 311 provided to compensate the unbalance caused by the eccentric load of the laundry in the drum.

The drum cover 31 may comprise a first uneven portion 315 formed in an inner circumferential surface to facilitate the demounting of the sub-drum 50, and an hooking portion 312 projected from the inner circumferential surface to prevent the upward movement of the drum 30 by interfering with a coupling unit 93 of the sub-drum 50 which may be provided to be coupled to the first uneven portion 315. In this instance, the coupling unit 93 may be flexibly movable into or from the sub-drum 50, in communication with a handle unit 510.

Figure 5:
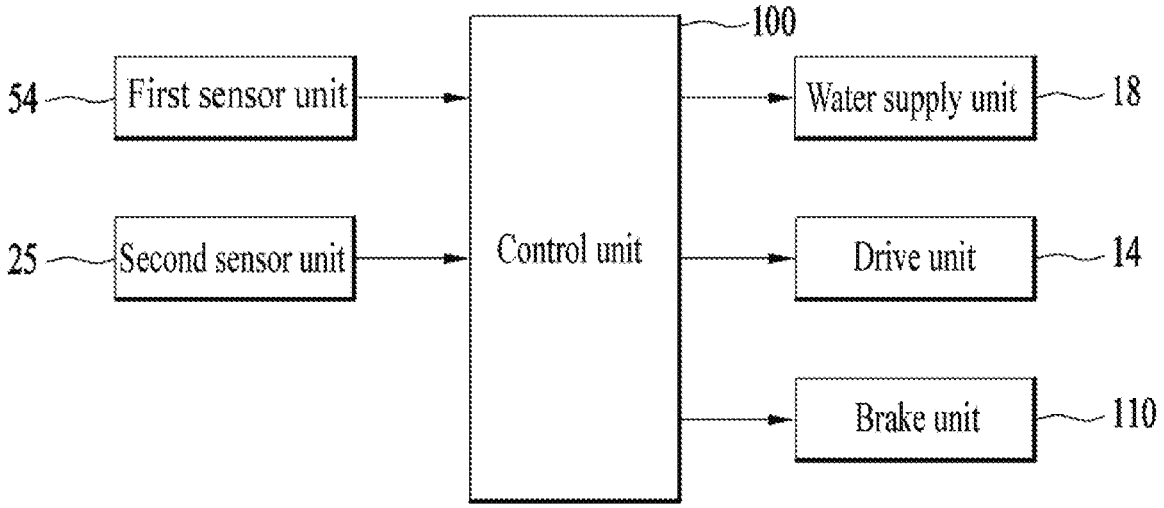
FIG. 5 is a block diagram illustrating the structure of a laundry treating apparatus in accordance with an embodiment of the present disclosure.

Meanwhile, the laundry treating apparatus in accordance with the embodiment may comprise a control unit (500, see FIG. 5) and a brake unit (110, see FIG. 5) so as to control the overall washing process. Also, the laundry treating apparatus may comprise a sensor unit configured to control an angle of the sub-drum 50 which will be described later. The sensor unit may comprise a first sensor unit 54 and a second sensor unit 25. The angle control of the sub-drum 50 may be performed for the water supply. As one example, it may be determined based on the angle control of the sub-drum 50 whether to perform the water supply to the inside of the drum 30 via the same water supply unit or to the inside of the sub-drum 50.

The first sensor 54 may comprise a first hall sensor 55 and a first magnet unit 56. The first hall sensor 55 may be provided in an upper surface of the tub cover or an inner circumference of the tub cover 20. In other words, the first hall sensor 55 may be provided in one of the fixed elements. The first magnet unit 56 may be installed on an upper surface of the sub-drum to be sensed by the first hall sensor 55.

When the sub-drum 50 is rotated, the first hall sensor 54 may sense the first magnet unit 56 and transmit a signal to the control unit 100. In the illustrated embodiment, one hall sensor and one magnet are provided in the first sensor unit 54 for easy understanding. However, the embodiments of the present disclosure are not limited thereto and the first sensor unit 54 may comprise a plurality of hall sensors and a plurality of magnets. Or, the first sensor unit 54 may comprise one hall sensor and the plurality of the magnets. The plurality of the magnets may be arranged at intervals having a preset angle. When one magnet is provided in one hall sensor, the hall sensor may generate one magnet sensing signal per one rotation of the sub-drum 50. When three magnets are provided in one hall sensor, the hall sensor may generate three magnet sensing signals per one rotation of the sub-drum 50. The first sensor unit 54 may determine whether the sub-drum 50 is mounted in the drum 30. Also, the first sensor unit 54 may determine whether the sub-drum 50 is mounted in the drum 30 normally.

As one example, when the first hall sensor 54 generates three magnet sensing signals per one rotation of the drum 30, the first hall sensor 54 may generate only two magnet sensing signals. In this instance, it may be determined that the sub-drum 50 is mounted in the drum abnormally.

When it is determined that the sub-drum 50 is mounted in the drum 30 normally, the sub-drum 50 and the drum 30 may be integrally rotated as one body. In other words, the rotation angle of the sub-drum 50 may be controlled by controlling the rotation angle of the drum 30.

In this embodiment, the second sensor unit 25 may be provided to control the rotation angle of the drum 30. More specifically, the sensor unit 25 may be provided to sense the rotation angle of the drum 30 and the rotation angle of the drum 30 may be controlled based on the result of the sensing of the second sensor unit.

More specifically, the second sensor unit 25 may comprise one second hall sensor 26 and a second magnet unit 27 so as to sense the rotation angle of the drum 30. The second hall sensor 26 may be provided on a bottom surface of the tub 20 and magnets of the second magnet unit 27 may be arranged along an outer circumference of a top surface of the rotor 15 to be sensed by the second hall sensor 26. When the drum 30 is rotated, the second hall sensor 26 may sense the rotation angle of the drum 30 and then transmit a signal to the control unit 100. To allow the second sensor unit 25 to sense the precise rotation angle of the drum 30, the magnets of the second magnet unit 27 may be provided on the rotor 15 at the equidistant intervals. The more magnets are provided, the more precise rotation angle of the drum may be sensed. In other words, the rotation angle of the drum 30 may be determined based on the rotation angle of the rotor 15 sensed by the second sensor unit 25. Meanwhile, the second sensor unit 25 may comprise the hall sensor fixedly provided on the stator, and a plurality of magnets provided on the rotor and rotatable together with the rotor.

Meanwhile, the rotation angle of the rotor 15 may be sensed without auxiliary sensor. In other words, the rotation angle of the rotor 15 may be sensed according to a sensorless method to determine the rotation angle of the drum 30. Such a sensorless method may be configured to allow a phase current of a preset frequency to flow to the motor and estimate the location of the rotor provided in the motor based on the output currents detected while the currents of the preset frequency flow to the motor. Such sensorless method is well-known knowledge and detailed description thereof will be omitted accordingly.

The control unit 100 may be configured to control the overall operation of the laundry treating apparatus (e.g., the wash cycle, the rinse cycle, the dry-spin cycle and the like) and operate the laundry treating apparatus according to the user's setting.

Especially, the control unit 100 may be implemented to receive the signals generated by the first sensor unit 54 and the second sensor unit 25 and control the drive unit 14 configured to rotate the drum 30, the water supply unit 18 configured to supply wash water, and the brake unit 110 configured to apply a brake to the rotating drum 30 based on the received signals. The control unit may perform the control of the rotation angle of the sub-drum 50 based on the control of the rotation angle of the drum 30. In other words, the control unit may control the sub-drum 50 to stop at a desired rotation angle.

The brake unit 110 may be implemented to stop the drum 30 by applying a brake to the rotating drum 30. In other words, the control unit may control the drum 30 and the sub-drum 50 to stop at a preset rotation angle.

Hereinafter, the sub-drum 50 will be described in detail, referring to FIGS. 2 through 4.

Figure 2:
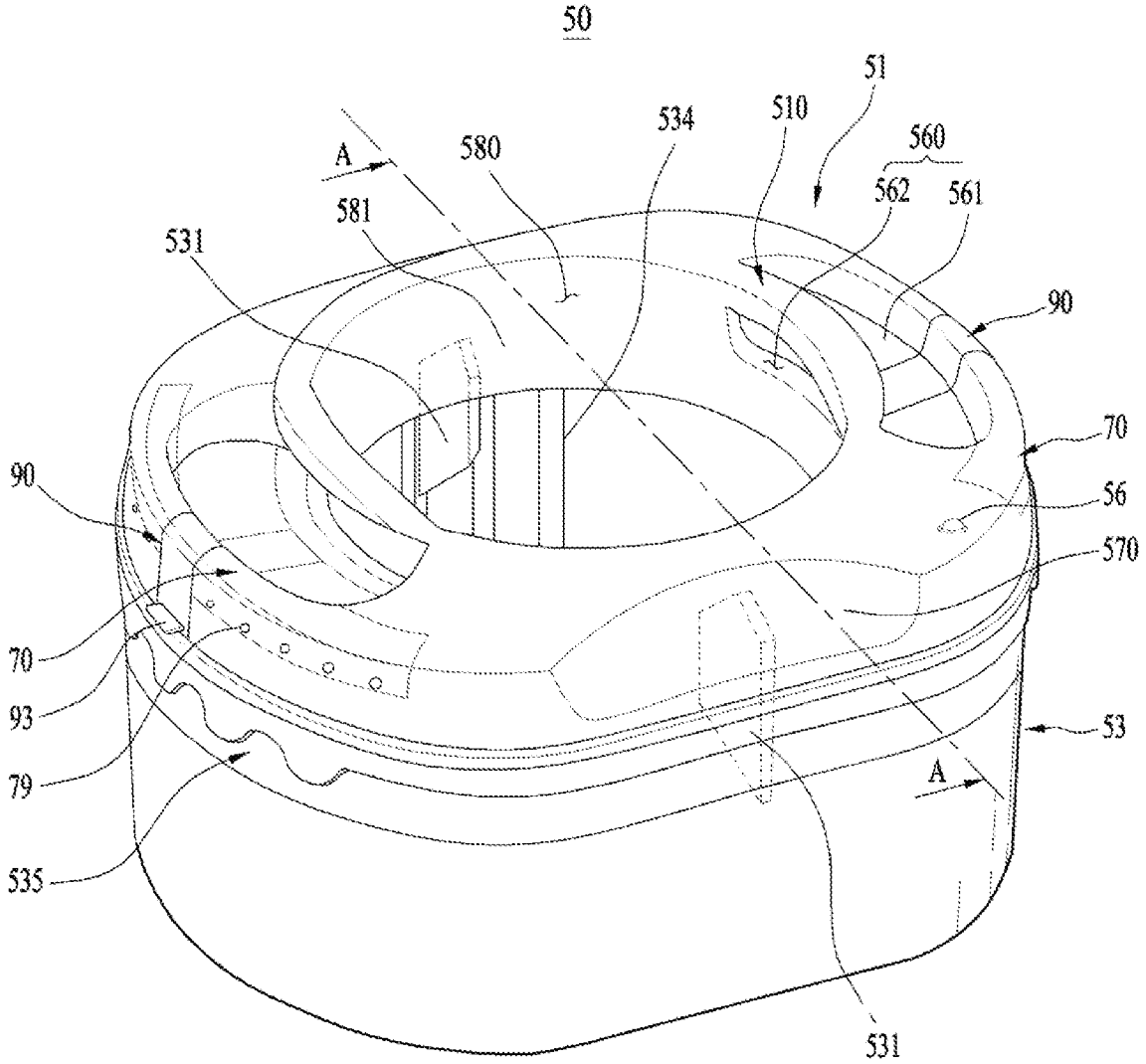
FIG. 2 is a perspective diagram illustrating a sub-drum of the laundry treating apparatus of FIG. 1.

FIG. 2 is a perspective diagram illustrating the sub-drum 50 which is shown in FIG. 1. FIG. 3 is a sectional diagram along A-A line which is shown in FIG. 2. FIG. 4 is a plane view illustrating the sub-drum 50 mounted in the drum 30.

Figure 3:
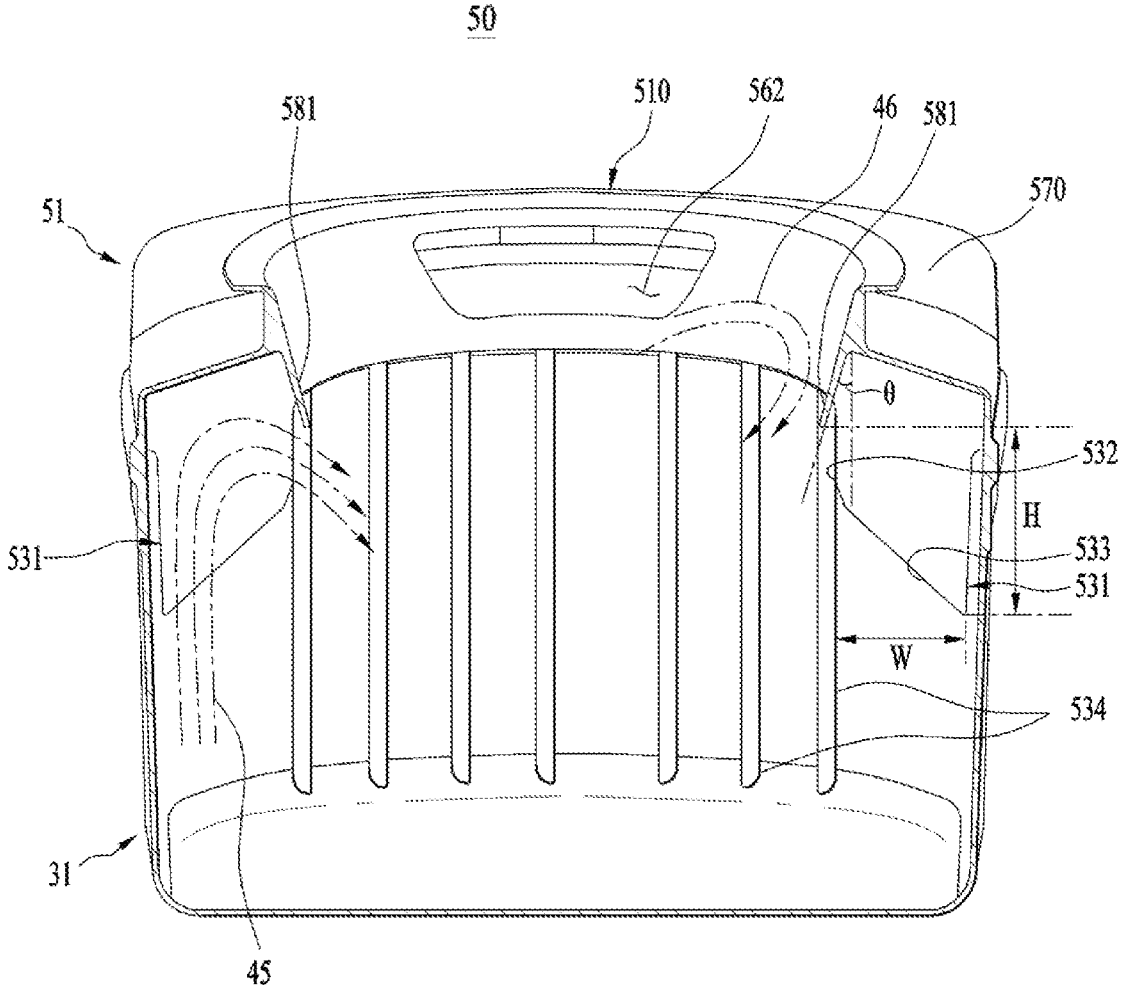
FIG. 3 is a sectional diagram along A-A line which is shown in FIG. 2.
Figure 4:
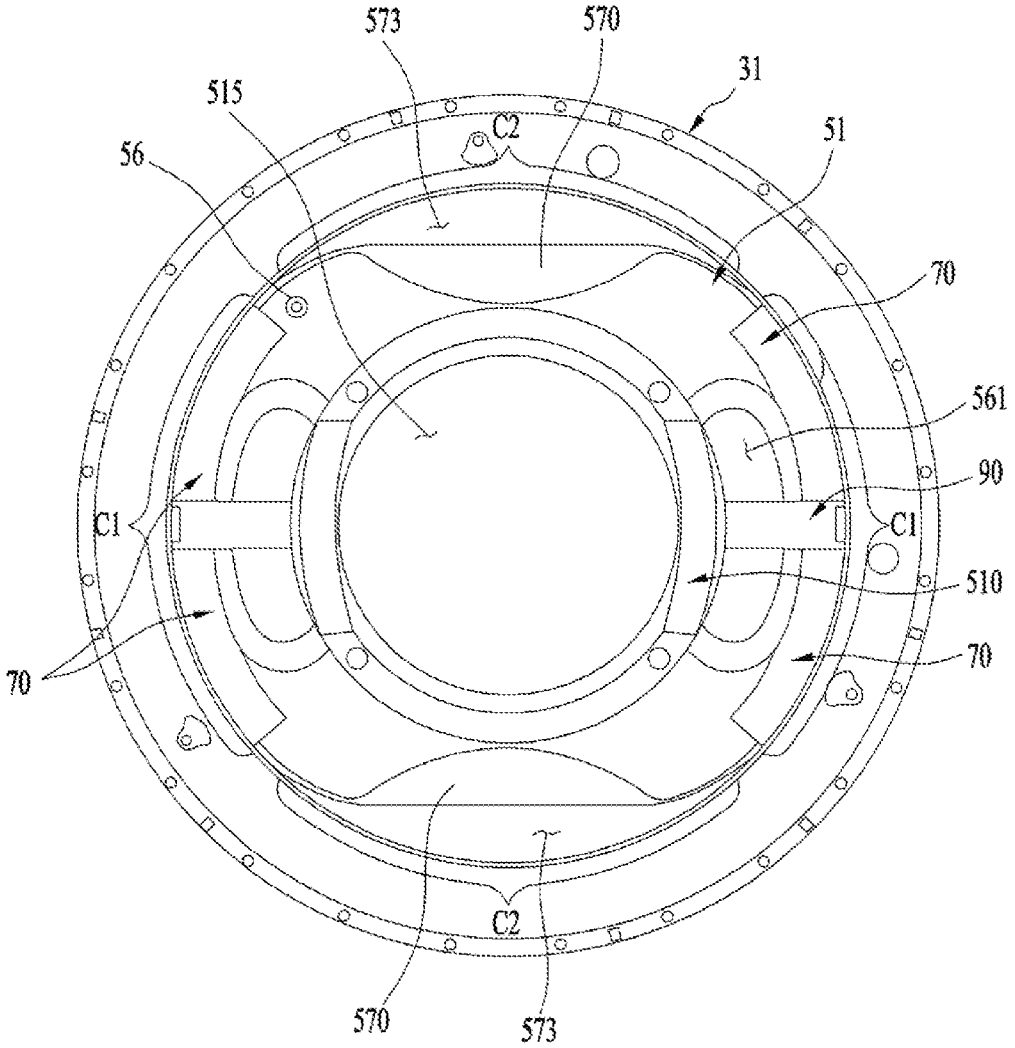
FIG. 4 is a plane view illustrating the sub-drum mounted in a drum in accordance with an embodiment of the present disclosure.

Referring to FIGS. 2 through 4, the sub-drum 50 may be detachably mounted in an upper end area of the drum 30. The sub-drum 50 may have a container shape with an open top. The laundry may be loaded or unloaded through the open top. Also, wash water may be supplied to the internal space of the sub-drum via the open tope and a cross section of the sub-drum may be formed in an approximately circular shape.

The sub-drum 50 may be configured to perform the washing, independent of the drum 30. After the laundry is sorted according to the color or fabric type and dividedly loaded into the drum 30 and the sub-drum 50, washing may be performed for the laundry supplied to the drum and the sub-drum simultaneously. Accordingly, the operation frequency of the laundry treating apparatus 1 may be reduced and the waste of the wash water, detergent and energy may be prevented at the same time. Also, the laundry may be sorted according to a contamination degree or the user's intended use of the laundry. As one example, laundry items such as lingerie or underwear may be dividedly washed from the laundry items which may be used in cleaning such that the user's satisfaction level about the separated washing may be remarkably enhanced. In addition, the water supply and drainage may be separately performed and the separated washing effect may be substantially enhanced.

The sub-drum 50 may perform the washing while being rotated by the rotational force transmitted from the drum 30 such that no auxiliary drive device may be provided since the sub-drum may be integrally rotated together with the drum.

The sub-drum 50 may comprise a sub-drum body 53 formed in a cylinder shape with an open top, a sub-drum cover 51 detachably coupled to an upper end of the sub-drum body 53, an outlet unit 70 configured to exhaust the wash water held in the sub-drum 50 outside when the sub-drum 50 is rotated at a high speed, and a coupling unit 93 configured to couple and decouple the sub-drum 50 to and from the drum 30.

The sub-drum body 53 may have an oval cross-section so as to form a vortex in the wash water and a friction rib 534 may be provided in an inner circumferential surface of the sub-drum body 53 to form a water current in the wash water.

The top loading type laundry treating apparatus 1 in accordance with the embodiment may perform the washing process by using the chemical action of the detergent and the friction between the water currents formed by the rotation of the drum and the laundry. The sub-drum body 53 having the oval-shaped cross section may generate the vortex by using the rotation more efficiently than the drum having the circular-shaped cross section. As the vortex increases the friction between the wash water and the laundry, the sub drum 50 having the oval-shaped cross section may enhance the washing efficiency.

Meanwhile, the sub-drum body 53 may include an inner circumferential surface formed with a first curvature area (C1) having a first curvature and a second curvature area (C2) having a second curvature which is smaller than the first curvature, as shown in FIG. 4.

A pair of first curvature areas (C1) may be formed in the areas of the sub-drum body 53 which face each other, respectively, and the first curvature may be identical to the curvature of the inner circumferential surface of the opening formed in the drum cover 31.

A pair of second curvature areas (C2) may be formed in the opposite areas of the sub-drum body 53 which face each other, respectively, while being located between the first curvature areas (C1). The second curvature may be smaller than the first curvature.

In other words, the first curvature areas (C1) and the second curvature areas (C2) may be alternatively provided along a circumference of the cross-sectional surface formed in the sub-drum body 53.

The inner circumferential surface of the sub-drum body 53 may be divided into a short distance area (C2) spaced a first distance apart from the rotational center of the sub-drum 50, and a long distance area (C1) spaced a second distance apart from the rotation center of the sub-drum 50. The second distance may be farther than the first distance. The long distance area (C1) may correspond to the first curvature area (C1) and the short distance area (C2) may correspond to the second curvature area (C2).

Meanwhile, a first water supply path 573 which will be described later may be formed as the short distance area (C2) may be spaced a sufficient distance apart from the inner circumferential surface of the drum-cover 31.

It is described that some area of the inner circumferential surface which the second curvature area (C2) indicates may be curved but the embodiments of the present disclosure are not limited thereto. The area of the inner circumferential surface may be plane. In this instance, it may be more appropriate that the second curvature area (C2) is named the short distance area (C2).

The first curvature area (C1), the second curvature area (C2), the long distance area (C1), the short distance area (C2), a coupling area (C1) and a distant area (C2) may indicate specific areas. All of the areas which belong to the above-noted specific areas may be referred to as the terms mentioned above. In the disclosure, some areas of the sub-drum body 53 and the sub-drum body 51 may be referred to as the above-noted terms.

It is shown in FIGS. 3 and 4 that the cross-sectional surface of the sub-drum 50 may be oval with respect to the overall height. However, the embodiments are not limited thereto. As one example, one short distance area (C2) may be formed or the short distance area (C2) may be formed only in the sub-drum body 53. In other words, the overall shape of the sub-drum cover 51 may be circular and only the sub-drum body 51 provided in the lower area of the sub-drum cover 51 to hold wash water may have the short distance area (C2). Such the short distance area may define some space that vertically penetrates the drum from the drum upper portion into the drum inside. Accordingly, it may be possible to form a penetrating area (not shown) in the sub-drum cover 51, corresponding to the short distance area.

Accordingly, as mentioned above, it may not be necessary to form the overall shape of the sub-drum 50 in the oval shape so as to supply the wash water to the inside of the drum by vertically dropping the wash water via the water supply unit 18, without passing through the sub-drum 50. Any shape may be possible only if the short distance area for allowing the wash water to vertically flow is formed in the sub-drum body 51. The control of the drum rotation angle may be performed to locate such short distance area to a corresponding area to the water supply unit 18.

Meanwhile, the sub-drum body 53 may comprise no through-holes 33 formed in the circumferential surface, different from the drum 30 including the through-holes 33 formed in the circumferential surface. Accordingly, the sub-drum body 53 may hold the wash water and the laundry and the wash water may not be exhausted into the drum 30 via the circumferential surface or lower surface. The wash water held in the tub 20 may only be drawn into the drum 30 via the through-holes 33, not into the sub-drum 50.

The friction rib 534 may be projected from the inner circumferential surface of the sub-drum body 53 vertically. A plurality of friction ribs 534 may be spaced a preset distance apart from each other and integrally formed with the sub-drum body 53. The friction ribs 534 may be rotated in the rotational direction of the sub-drum body 53 by the frictional force with the wash water during the rotation of the sub-drum body 53. The friction ribs 534 may be different from guide ribs 531, which will be described later, in shape and function.

The sub-drum cover 51 may be coupled to an upper end of the sub-drum body 53, having a cross sectional surface which may be equal to the cross-sectional surface of the sub-drum body 53.

Accordingly, the circumferential surface of the sub-drum cover 51 may be divided into a first curvature area (C1) and a second curvature area (C2). The first curvature area (C1) may be named a first long distance area (C1) and the second curvature area (C2) may be named a second short distance area (C2). Different from the first and second curvature areas (C1) and (C2) of the sub-drum body 53, the first curvature area (C1) of the sub-drum cover 51 may be coupled to the inner circumferential surface of the drum cover 31 and named a distant area (C2). Also, the second curvature area (C2) may be spaced apart from the inner circumferential surface of the drum cover 31 and then named the distant area (C2).

The sub-drum cover 51 may comprise a laundry introduction opening 580 formed in an upper surface to introduce the laundry, and a handle unit 510 which may provide a predetermined space to be grabbed by the user.

In addition, the sub-drum cover 51 may comprise an inner water supply guide 560 configured to guide the wash water exhausted from the water supply unit 18 into the sub-drum 50, and an outer water supply guide 570 configured to guide the wash water exhausted from the water supply unit into the drum 30 along an outer surface of the sub-drum 50.

The inner water supply guide 560 may function to guide the wash water supplied via the water supply unit 18 into the sub-drum smoothly, not into the drum simultaneously.

The outer water supply guide 560 may function to guide the wash water supplied via the water supply unit 18 into the drum smoothly, not into the sub-drum simultaneously.

The sub-drum cover 51 may comprise a guide rib 531 provided to lift the wash water circulating along the inner circumferential surface of the sub-drum body 53 after the flow direction is changed by collision and fall to the center of the sub-drum body 53.

The handle unit 510 may be formed in an upper surface of the sub-drum cover 51 and may comprise a pair of handle units 510 facing each other.

The handle unit 510 may be arranged adjacent to the first curvature area (C1), in other words, the long distance area (C1) of the sub-drum cover 51. When the wash water is one-sided by the shock applied when the user demount the sub-drum 50 from the drum 30, rolling might occur in a left-and-right direction while the sub-drum 50 is rotating on a virtual axis passing the pair of the long distance areas (C1). When the handle unit 510 is provided near the second curvature area (C2), in other words, the short distance area (C2), the user may have to apply a strong force so as to steady the vertical vibration of the sub-drum 50 such that it may be more advantageous to locate the handle unit 510 near the long distance area (C1).

The inner water supply guide 560 may be provided in an upper surface of the sub-drum cover 51, more specifically, the long distance area (C1), in other words, a coupling area (C1). The inner water supply guide 560 may comprise a concave area 561 and a water supply hole 562.

To form the concave area 561, some areas may be recessed from the upper surface of the sub-drum cover 51 not to spread the wash water exhausted from the water supply unit 18 around after being collided against the upper surface of the sub-drum cover 51.

The water supply hole 562 may be formed in an inner surface of the concave area toward the laundry introduction opening 580 to communicate the concave area 561 with the laundry introduction opening 580. Accordingly, as the wash water is guided to the laundry introduction opening 580 via the water supply hole 562 from the concave area 561, the water supply hole 562 may form a second water supply path 562 to guide the wash water to the sub-drum 50.

The wash water exhausted from the water supply unit 18 may be temporarily stored in the concave area 561 such that the wash water may not be spread around the sub-drum cover 51 and then exhausted to the laundry introduction opening 580 via the water supply hole 562, in other words, the second water supply path 562 to be guided into the sub-drum 50.

Meanwhile, the concave area 561 and the water supply hole 562 may be formed in a lower area of the handle units 510 such that the spatial efficiency of the sub-drum cover 51 can be maximized.

The outer water supply guide 570 may be provided in the sub-drum cover 51, for example, in the short distance area (C2), in other words, the distant area (C2). More specifically, the outer water supply guide 570 may be spaced apart from the inner water supply guide 560. The sub-drum 50 may be rotated a preset angle together with the drum 30, to locate the inner water supply guide 560 and the outer water supply guide 570 under one water supply unit 18. Accordingly, even when the outer water supply guide 570 is separated from the inner water supply guide 560, the wash water exhausted from one water supply unit 18 may be supplied to the drum 30 and the sub-drum 50, respectively.

The outer water supply guide 570 may be formed by recessing a corner of the distance area (C2) into the sub-drum cover 51 and a bottom surface may be inclined outwards and downwards with respect to the sub-drum cover 51. The wash water exhausted from the water supply unit 18 may be guided into the drum 30 along the first water supply path 573 defined as the space formed between the distant area (C2) and the outer circumferential surface of the drum 30.

The guide rib 531 may be formed in a plate shape and provided under the upper surface of the sub-drum cover 51, being extended downwards. The guide rib 531 may have one surface contacting the inner circumferential surface of the sub-drum body 53. More specifically, the plate-shaped guide rib 531 may have the top coupled to the sub-drum cover and one side surface in contact with the inner circumferential surface of the sub-drum body 53. Accordingly, the wash water held in the sub-drum body 53 may be rotated along the inner circumferential surface of the sub-drum body 53 by the rotational force of the sub-drum 50 and the flow direction of the wash water may be changed by the collision with the guide rib 531 to flow upwards and fall down to the center of the sub-drum 50 in an arc.

More specifically, the guide rib 531 may be formed in one surface toward the side surface toward the center of the sub-drum body 53. The guide rib 531 may comprise a rib vertical area 532 downwardly extended from the upper surface of the sub-drum cover 51, and a rib inclined area 533 formed in a lower surface toward the bottom of the sub-drum body 53, downwardly extended from the rib vertical area and the center of the sub-drum 50 toward the inner circumferential surface.

The rib inclined area 533 may be spaced apart from the lower surface of the sub-drum body 53, while forming an acute angle with the inner circumferential surface of the sub-drum 50.

As the rib inclined area 533 is formed in the lower surface of the guide rib 531, the laundry rotated and flowing in the inside of the sub-drum body 53, together with the wash water, may be less interfered with. Accordingly, the flow of the laundry may be performed more efficiently and the friction between the laundry items may be increased enough to enhance the washing efficiency or performance.

Meanwhile, even if the rib inclined area 533 is formed in the guide rib 531, a sufficient amount of wash water can be lifted. For example, when the sub-drum 50 is rotated at a high speed, a water level of the wash water held in the inner circumferential surface of the sub-drum body 53 may be higher than a water level of the wash water held in the center of the sub-drum body 53. Accordingly, even if the rib inclined area 533 is formed in the guide rib 531, sufficient wash water can be collided with the guide rib 531 to be lifted.

Meanwhile, when the sub-drum 50 is rotated at a relatively low speed, the guide rib 531 may be arranged in the short distance area (C2) of the sub-drum cover 51 to lift a sufficient amount of wash water. The amount of the wash water passing through a virtual section from the center of the sub-drum body 53 to the short distance area (C2) may be equal to the amount of the wash water passing through a virtual section from the center of the sub-drum body 53 to the long distance area (C1). Accordingly, the water level of the wash water when passing through the virtual section to the short distance area (C2) from the center of the sub-drum body 53 may be higher than the water level of the wash water when passing through the virtual section to the long distance area (C1) such that the guide rib 531 can lift the sufficient amount of the wash water even when the sub-drum 50 is rotated at the low speed.

The guide rib 531 may have one surface configured to collide with the wash water and the other opposite surface, which may be upwardly inclined toward the flow direction of the wash water. In other words, when viewing the guide rib 531 from the center of the sub-drum body 53 in a radial direction, the width of the lower cross section may be larger than the width of the upper cross section. Accordingly, the wash water may be lifted along the one surface and the other surface of the guide rib 531 more efficiently.

By experiments, it is shown in FIG. 3 that the high washing efficiency may be generated together with an inclined guide, when the horizontal length and the height of the sub-drum 50 is about 399 mm and 309.2 mm, respectively, and the height (H) and the width (W) of the guide rib 531 are about 70 mm and 65 mm, respectively. When the experiment is performed in a state the height (H) of the guide rib 531 is set between about 50 mm and 90 mm with the other values the same, more enhanced washing performance may be gained for some contaminants but an average of the values may be lower than an average when the height (H) of the guide rib 531 is set to about 70 mm. Meanwhile, such values are just one example gained by the experiments and specific values of the sub-drum 50 and the guide rib 531 are not limited thereto.

The pair of the guide ribs 531 may be provided in the short distance area (C2), respectively, as mentioned above, and the embodiments are not limited thereto. More guide ribs 531 may be provided in the long distance area (C1) to be two pairs.

The incline guide 581 may be provided above the guide rib 531 and downwardly inclined to the inside of the sub-drum 50. More specifically, the inclined guide 581 may be formed along an inner area, in other words, an inner circumferential surface of the laundry introduction opening 580 provided above the guide rib 531.

Without the inclined guide 581, the wash water lifted by the guide rib 531 may flow to an upper area of the inner circumferential surface of the sub-drum body 53 and then a lower area of the upper surface toward the center of the sub-drum body 53. After that, the wash water may fall into the sub-drum body 53 freely, while drawing an arc.

When the inclined guide 581 is installed, the wash water may not fall freely. In other words, the wash water horizontally flowing along the lower area of the upper surface of the sub-drum cover 51 may form the flow 45 of which a direction may be drastically changed downwards by the lower surface of the inclined guide 581. More specifically, the horizontal component speed may be partially changed into the vertical component speed. The wash water of which the flow direction is drastically changed may collide against the laundry loaded in the sub-drum body 53 more strongly than the wash water falling down freely. At this time, the inclination angle (Θ) of the inclined guide 581 may be set as approximately 10 degrees with respect to the direction of gravity. The angle at which the flow direction of the wash water is changed may be set larger. Accordingly, a stronger shock may be applied to the laundry loaded in the sub-drum body to enhance the washing performance.

It is described that the inclination angle (Θ) may be approximately 10 degrees. Such value is one example, and such value is not limited thereto.

Meanwhile, when the sub-drum 50 is rotated at a high speed, the wash water held in the sub-drum 50 could collide with each other to splash to the laundry introduction opening 580. At this time, the inclined guide 581 may be configured to guide the splashed wash water into the sub-drum 50 along the upper surface so as to form the flow 46 to the sub-drum 50.

The sub-drum 50 may have a second uneven area 535 formed in an outer circumferential surface to be seated on an inner circumferential surface of a balancer 311 while engaging with a first uneven area 315 formed in the balancer 311. The second uneven area 535 may be formed in the coupling area (C1) of the outer circumferential surface of the sub-drum body 53. It may be preferred that the second uneven area 535 is not formed in the outer circumferential surface of the sub-drum cover 51. The wash water held in the sub-drum body 53 and the weight of the laundry might separate the sub-drum cover 51 from the sub-drum body 53.

Meanwhile, a control method of the laundry treating apparatus 1 in accordance with an embodiment may determine whether the sub-drum 50 is mounted in the drum 30 before starting the washing or performing the water supply for the washing. Also, the control method may determine whether the sub-drum is mounted normally and it may be performed by using the first sensor unit 54.

In this instance, the control unit 100 may perform preset determination processes based on the sensing signal transmitted from the first sensor unit 54 and the second sensor unit 25 or the sensing signal transmitted from the first sensor unit 54 and the output currents detected while predetermined frequency currents are flowing to the motor, and may control the water supply unit 18, the motor 14 and the brake unit 110 based on the result of the determination processes. The sensing signal transmitted from the second sensor unit 25 and the output currents detected while the preset frequency currents are flowing to the motor may be used when the control unit 100 measures the rotation angle of the drum 30. Hereinafter, for easy and convenient description, the second sensor unit 25 is exemplified as the element configured to sense the rotation angle of the drum. Detailed description about the relation between the elements for the water supply will be omitted.

Meanwhile, the embodiment for the location control of the drum 30 and the sub-drum 50 to supply wash water is described. However, the location control of the drum 50 and the sub-drum 50 for the location control of the handle units 510 may be performed.

The user may be able to separate the sub-drum 50 from the drum 30 while holding the handle units 510. Accordingly, it may be preferred that the handle units 510 are determined to allow the user to easily grab the handle units 510 from the surface of the laundry treating apparatus. The location control of the drum 30 may be performed to locate the handle units 510 at a desired position.

More specifically, the location control of the sub-drum 50 may be performed at a place where the sub-drum 50 is decoupled. As one example, the location control may be performed to pause or end the washing course.

When the sub-drum 50 is mounted in the drum 30 only at a specific location, the location control of the drum may be performed for an easy coupling process. As one example, the location control may be performed to pause the washing without the sub-drum 50 or start and end the washing without the sub-drum 50.

In other words, the rotation location control of the drum and/or sub-drum 50 (the stopping of the drum and/or sub-drum 50 at a preset location) may be performed for the water supply and for easy and convenient mounting and/or demounting of the sub-drum.

Figure 6:
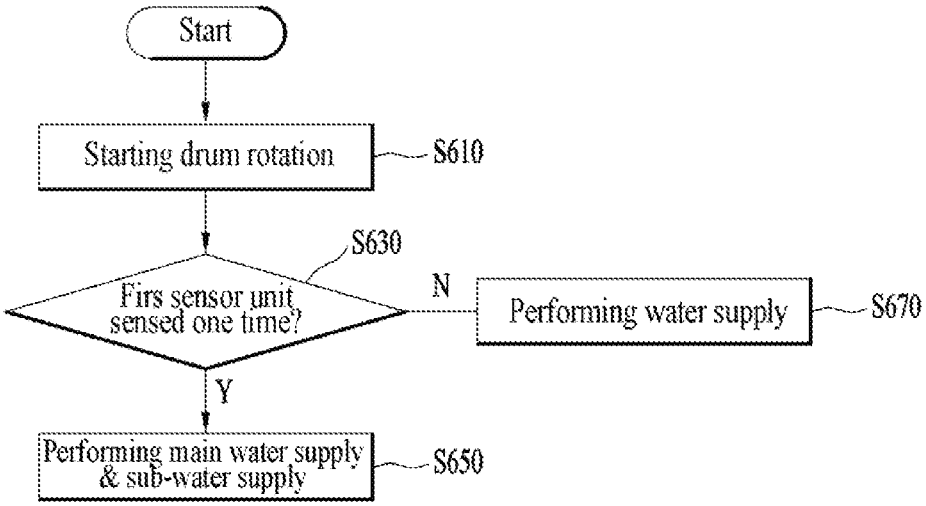
FIG. 6 is a flow chart illustrating a step for determining whether the sub-drum is mounted in the drum in accordance with an embodiment of the present disclosure.

Referring to FIG. 6, the control method in accordance with an embodiment will be described in detail.

It may be determined whether the washing course is performed only in the drum 30 or the sub-drum 50. For that, the drum may be rotated (S610) to determine whether the sub-drum 50 is mounted or whether the sub-drum 50 is normally mounted. It can be said that such determination may be performed to determine whether to supply wash water only to the drum 30 or both of the drum 30 and the sub-drum 50.

More specifically, the control unit 100 may be implemented to control the drive unit 14 to rotate the drum 30. When the drum 30 is rotated, the second sensor unit 25 may sense the rotation angle of the drum 30 and may transmit a signal to the control unit 100.

Meanwhile, when a normal signal is not received from the first sensor unit, it may be determined that the sub-drum is not mounted or that the sub-drum is mounted abnormally. As one example, when receiving no signal from the first sensor unit 54 while the second sensor unit 24 senses that the rotation angle of the drum 30 is 360 degrees, the control unit 100 may determine that the sub-drum 50 is not mounted in the drum 30 (S630-N).

When determining that the sub-drum 50 is not mounted in the drum 30, the control unit 100 may be implemented to control the water supply unit 18 to supply wash water to the drum 30 (S670). In this instance, the location control of the drum for the water supply may not be performed. In other words, the control unit 100 may not control the drive unit 18 and the brake unit 110 to locate the outer water supply guide 570 or the inner water supply guide 560 under the water supply unit.

When it is determined that the sub-drum 50 is mounted abnormally, an alarm may be provided.

Meanwhile, when a normal signal is received from the first sensor unit, it may be determined that the sub-drum is mounted normally. As one example, when receiving the signal from the first sensor unit 54 while the second sensor unit 25 senses that the rotation angle of the drum 30 is 360 degrees, the control unit 100 may determine that the sub-drum 50 is mounted in the drum 30 (S630-Y).

Once determining that the sub-drum 50 is mounted in the drum 30 normally, the control unit 100 may be implemented to perform the location control of the sub-drum 50 so as to supply wash water.

As one example, the control unit may perform a main water supply to the drum 30 by locating the outer water supply guide 570 under the water supply unit 18. The control unit 100 may perform a sub-water supply configured to rotate the sub-drum 50 a preset angle and then locate the main water supply and the inner water supply guide 560 under the water supply unit 18 (S650). Of course, the main-water supply may be performed after the sub-water supply.

Once the water supply starts, wash water may be exhausted via the water supply unit 18. The exhausted wash water may be supplied to the sub-drum 50 via the water supply guide 560 and to the drum 30, in other words, the tub 20 via the outer water supply guide 570. In other words, the water supply may be performed after the angle control is performed configured to locate the inner water supply guide 560 and the outer water supply guide 570 under the water supply unit 18 by rotating the sub-drum 50.

For example, the control unit 100 may control the drive unit 14 to rotate the sub-drum 50 at a low rpm for the water supply. In this instance, the rpm is set as '3'. When the first sensor unit 54 transmits a sensing signal to the control unit 100, the control unit 100 may rotate the sub-drum 50 a preset angle from the moment when the first sensor unit 54 sends the sensing signal and locate the outer water supply guide 570 under the water supply unit 18. The rotation angle may be preset according to the arrangement relation among the first sensor unit 54, the outer water supply guide 570 and the water supply unit 18.

The rotation angle of the sub-drum 50 may be measured by the second sensor unit 25 and transmitted to the control unit 100, while the sub-drum 50 is rotated at a very low rpm. The control unit 100 may control the brake unit 110 to stop the sub-drum once determining that the measured rotation angle reaches a preset rotation angle.

As the rpm of the sub-drum 50 is very low, the distance of the sliding sub-drum 50 from the point when the brake unit 110 starts may be so small to be ignored. When the sub-drum 50 is stopped by the brake unit 110, the outer water supply guide 570 may be almost located under the water supply unit 18. Accordingly, the wash water exhausted from the water supply unit 18 may be supplied to the drum 50 via the outer water supply guide 570, without correcting the location of the sub-drum 50.

Meanwhile, as the rpm of the sub-drum 50 is very low, the control unit 100 may cut off the currents flowing to the drive unit from the point or in a preset time period when the first sensor unit 54 senses the location of the sub-drum 50. At this time, the sub-drum 50 may be by the inertia. However, the angle of the rotation caused by the inertia at the low rpm may be so small to be ignored or expected from the current cut-off point. The stopping location of the sub-drum may be expected at the current cut-off point based on the rpm and the location of the sub-drum at the sensing point of the first sensor unit. The location control of the sub-drum 50 may become simpler on the assumption that there is no big error of the expected location.

The braking caused by the rotation of the sub-drum 50 to supply wash water via the inner water supply guide 560 may be equal to the braking caused by the rotation of the sub-drum 50 to supply wash water via the outer water supply guide 570 mentioned above.

Meanwhile, as another example for the precise location control of the sub-drum 50, the control unit 100 may control the drive unit 14 to slidingly move the sub-drum 50 from the point when the brake is applied to the sub-drum by raising the rpm of the sub-drum 50. In this instance, the rpm may be set as '15~25' and the embodiments are not limited thereto.

In this embodiment, the rotation angle to locate the outer water supply guide 570 under the water supply unit 18 when the first sensor unit 54 transmits a sensing signal may be also preset according to the arrangement relation among the first sensor unit 54, the outer water supply guide 570 and the water supply unit 18. However, in the preset rotation angle of this embodiment may be set to be the same value with the preset rotation angle in the above-noted embodiment. Considering the sliding distance of the sub-drum, the preset rotation angle of this embodiment may be smaller than that of the above-noted embodiment.

Similar to the above-noted embodiment, the rotation angle of the sub-drum 50 may be measured during the rotation of the sub-drum and the measured values may be transmitted to the control unit 100. Once determining that the measured rotation angle reaches a preset rotation angle, the control unit 100 may control the brake unit 110 to stop the sub-drum 50.

The sub-drum 50 may have variable sliding angles at which the sub-drum 50 is sliding from the brake start point by the wash water held therein and the weight of the laundry. Especially, when the rpm is relatively high, such a sliding angle may be diversified. When the second sensor unit 25 measures the sliding angle of the sub-drum 50 and transmits the measured angle to the control unit 100, the control unit 100 may correct the preset rotation angle. For example, the control unit may correct the preset rotation angle to be smaller when the sliding angle of the sub-drum 50 is large enough for the outer water supply guide 570 to pass by the lower area of the water supply unit 18. In vice versa, the control unit 100 may correct the preset rotation angle value to be larger. At this time, the rpm may be 15~25 rpm which is higher than 3 rpm and lower than 40~49 rpm in the conventional washing such that little load may be applied to the drive unit 14. Accordingly, the overload of the drive unit may be prevented and the precise location control of the sub-drum may be facilitated. In other words, after the correcting process is performed to prevent a deviation or an error, the location control of the sub-drum may be performed and the precise location control of the sub-drum may be then performed.

Meanwhile, in case the washing process is performed by the drive unit 14 rotating the drum 30 and the sub-drum 50 after wash water is supplied to the sub-drum 50, much load might be applied to the drive unit 14 by the weight of the laundry and wash water held in the sub-drum 50 to raise the temperature of the drive unit 14 drastically.

As the load of the sub-drum 50 as well as the load of the drum 30 is applied to the drive unit 14, there might be problems which are not expected when only the drum is driven.

Figure 7:
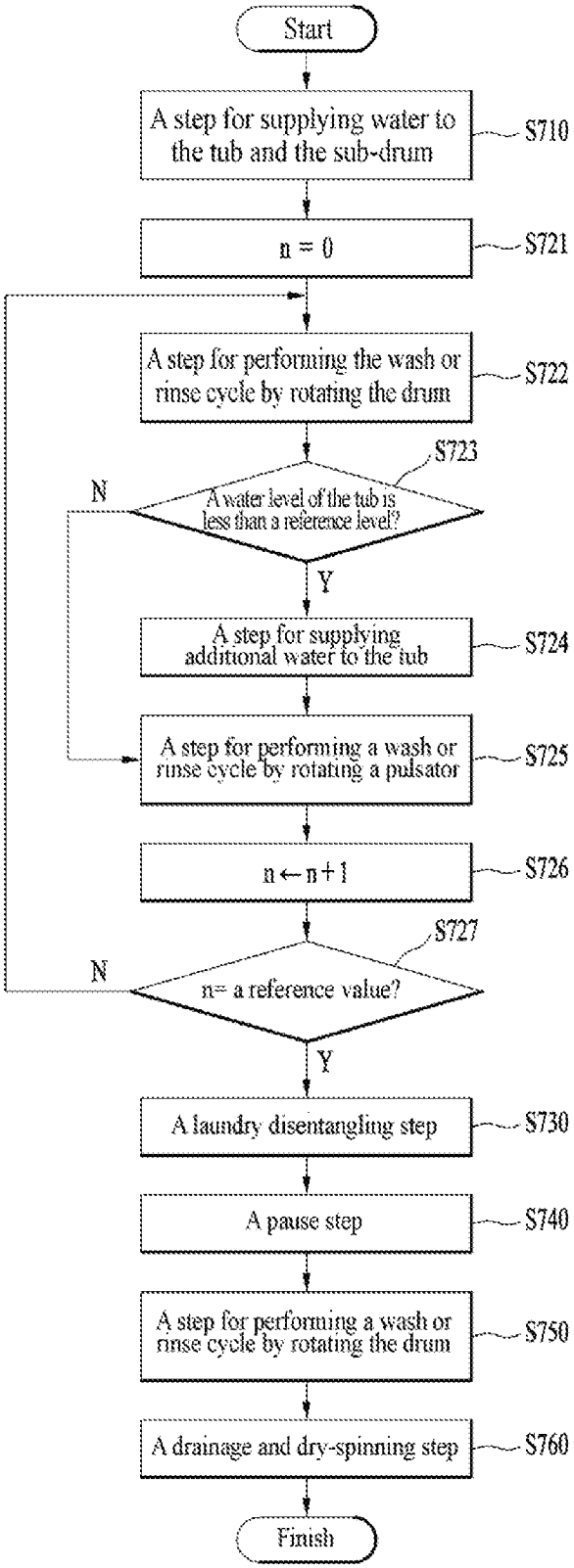
FIG. 7 is a flow chart illustrating a control method of the laundry treating apparatus in accordance with an embodiment of the present disclosure.

Hereinafter, a control method in accordance with one embodiment to solve the problem of the drastically raised temperature of the drive unit 14 will be described in detail, referring to FIG. 7. FIG. 7 is a flow chart illustrating a control method of the laundry treating apparatus 1 in accordance with an embodiment.

In the laundry treating apparatus 1 in accordance with an embodiment, water supply, washing, rinsing, drainage and dry-spinning may be independently performed for the tub 20 and the sub-drum 50. For that, the drum 30 and the pulsator 35 may be driven in various ways.

In the control method of the laundry treating apparatus 1 in accordance with the embodiment, a drive motion of the drum 30 and the pulsator 35 may be related with the size of the load applied to the drive unit 14 as well as the rpm and rotation directions of the rotating drum 30 and pulsator 35.

The control method of the laundry treating apparatus may comprise a basket motion and a pulsate motion. The control method may further comprise one or more of a stop motion, an angle control motion, a balance motion and a low speed rotation motion. Hereinafter, the various drive motions configured to drive the drum and the pulsator 35 which are applicable to the embodiment of the present disclosure will be described in detail.

The basket motion may be configured to form the water currents in the wash water held in the drum 30 and the sub-drum 50. The basket motion may be performed to form the water currents in the wash water supplied to the drum 30 and the sub-drum 50 simultaneously by the drive unit 14 rotating the drum 30 and the sub-drum 50 together in a clockwise-and-counter-clockwise direction. At this time, the pulsator 35 may not be rotated.

More specifically, the basket motion may be performed as the drive unit 14 transmits the rotational force to the drum 30 after wash water is supplied to the laundry loaded in the tub 20 and the laundry loaded in the sub-drum 50. The drive unit may rotate the drum 30 at a high rpm to perform the wash or rinse cycle for the laundry loaded in the drum 30 and the sub-drum 50 during the basket motion. For example, the drum 30 may be rotated at approximately 90 rpm and may be rotated in a range approximately from 75 rpm to 90 rpm according to the weight of the laundry and the wash water loaded therein. Accordingly, when the basket motion is performed, the temperature of the drive unit 14 may drastically rise.

There are two methods configured to drive the pulsator 35 and the drum 30 by rotating one drive unit or shaft 17.

In one method (or a first type), the shaft 17 may be connected with the pulsator consistently and the drum 30 selectively. When the shaft 17 is rotated, the drive force may be consistently transmitted to the pulsator 35 to rotate the pulsator 35 and it may be selectively transmitted to the drum 30. When the drive force is transmitted to the drum 30, the drum 30 and the pulsator 35 may be rotated at the same rpm. In this instance, the drive force may be transmitted only to the pulsator in the pulsate motion and the drive force may be transmitted to both the pulsator and the drum in the basket motion.

In the other method (or a second type), the shaft 17 may be selectively connected with only one of the pulsator 35 and the drum 30. When the shaft 17 is rotated, the drive force may be transmitted only to one of the pulsator 35 and the drum 30. In this instance, the drive force may be transmitted only to the pulsator in the pulsate motion and only to the drum in the basket motion.

Any types of the two may have an effect of substantial washing in the sub-drum 50 during the basket motion. As a large drive force is applied to the sub-drum 50 which is relatively lighter and smaller, a strong water current may be formed in the sub-drum 50.

The effect of the washing for the laundry loaded in the drum 30, which is relatively large and heavy, may be little. That is because a strong water current may not be formed in the drum during the basket motion. Even if a strong water current is formed in the drum during the basket motion, such a strong water current may be too strong drive force to the sub-drum 50 such that the drive unit should be designed larger than necessary, which is shown more noticeably in the second type.

When the effect of the laundry washing during the basket motion is expected in the second type like the first type, too much load may be caused during the basket motion. More load may be generated during the basket motion in the second type than the first type. The drive unit of which the capacity and performance is enhanced noticeably may be required, without using the conventional drive unit, which may not be preferred in terms of energy and production cost.

The pulsate motion may be configured to form a water current in the wash water held only in the drum 30. In the pulsate motion, the drive unit 14 may rotate only the pulsator 35 in a clockwise and counter-clockwise direction to form a water current in the wash water supplied to the drum 30. At this time, the drum 30 and the sub-drum 50 may not be rotated. In other words, the rotation of the pulsator 35 may use the drive in the conventional washing machine. It can be said that the same load is applied to the drive unit, regardless of the presence of the sub-drum mounted in the drum.

The pulsate motion may be performed as the drive unit 14 transmits the rotation force to the pulsator 35 after wash water is supplied to the laundry loaded in the tub 20 and the laundry loaded in the sub-drum 50 or only to the tub 20. During the pulsate motion, the drive unit may rotate the pulsator 35 at a high rpm to wash or rinse the laundry loaded in the drum 30.

During the pulsate motion, the sub-drum 50 may be stopped. Accordingly, the washing effect for the laundry loaded in the sub-drum 50 during the pulsate motion may be little. Substantially, it can be said that only the laundry loaded in the drum may be washed substantially.

The rpm of the pulsator 35 may be set as approximately 165 rpm, not limited thereto. The rpm may be set variously according to the weight of the wash water and laundry loaded in the drum 30. For example, when the weight of the dried laundry loaded in the drum 30 is approximately 5 kg, the rpm of the pulsator 35 may be set in a range of approximately 145~165 rpm. When the pulsate motion is performed, the temperature of the drive unit 14 may rise. At this time, the temperature of the drive unit 14 may rise in the pulsate motion less drastically than the basket motion.

The embodiment provides a control method which may be able to result in the optimal result in the washing effect of the basket and pulsate motions and the overload or temperature rise of the drive unit. Also, auxiliary motions together with the basket motion and the pulsate motion may be combinedly realized to derive the optimal control method.

Rather than the basket motion and the pulsate motion, embodiments of the auxiliary motions will be described in detail. One or more of the motions which will be described later may be performed together with the basket motion and the pulsate motion in the wash cycle or the rinse cycle. It may be obvious that the basket motion, the pulsate motion and the auxiliary motions should not performed simultaneously.

A balance motion may be configured to disperse the laundry in the drum 30 uniformly. The balance motion may be performed by repeating the clockwise and counter-clockwise direction rotations. At this time, the drum 30 and the sub-drum 50 may not be rotated. During the balance motion, the drive unit may rotate the pulsator 35 at a lower rpm than the rpm of the rotating pulsator 35 during the pulsate motion. For example, the rpm of the pulsator 35 may be set as approximately 140 rpm. The rpm may be set as approximately 130~140 rpm according to the weight of the laundry and wash water loaded in the drum 30. Accordingly, when the drive unit 14 is lifted by the basket motion or the pulsate motion performed before the balance motion, the balance motion may be performed and the temperature of the drive unit 14 may be then lowered.

A stop motion may be configured to temporarily stop or pause the drive unit not to rotate the sub-drum 50 and the pulsator 35. As the drive unit 14 is not operated, the effect of lowering the rising temperature of the drive unit 14 may be larger in the stop motion than in the other motions.

An angle control motion may be configured to control an angle to locate the sub-drum 50 in a specific location. When the angle control for the water supply is performed, the angle control motion may be performed. The water supply may be performed during the washing, in addition to the initial water supply. In other words, additional water supply may be performed. During the additional water supply, the angle control motion may be performed. After the angle control motion is performed, the additional water supply may be performed.

As mentioned above, the angle control motion may be configured to control the rotation of the drum 30 to locate the outer water supply guide 570 and/or the inner water supply guide 560, which are formed in the sub-drum 50, under one water supply unit. In the angle control motion, the rotation speed of the drum 30 may be set in a range of approximately 15~25 rpm or at a low speed of approximately 3 rpm such that the load of the drive unit may be very small. Accordingly, when the temperature of the drive unit 14 rises during the basket motion or the pulsate motion, the temperature lowering effect for the drive unit 14 may be gained in the angle control motion.

However, the angle control motion may not have to be performed before the additional water supply, because water can be supplied to the drum and the sub-drum independently via the water supply units, not one water supply unit 18. In any case, it may be preferred that the stop motion mentioned above is performed during the additional water supply to perform the stable water supply and also to perform the additional water supply as much as needed by measuring the water supply level.

A low speed rotation motion may be configured to rotate the drum 30 at a very low speed. For example, the low speed may be set in a range of 19~21 rpm, especially, as 20 rpm. The low speed rotation motion may form little water current in the wash water held in the drum and the sub-drum 50 such that it may be used so as to lower the raised temperature of the drive unit.

Meanwhile, as mentioned above, the wash or rinse cycle for the laundry loaded in the drum 30 may be usually performed by rotating the pulsator 35. The washing or rinsing may be performed by rotating the drum 30. In this instance, the washing or rinsing effect gained by rotating the drum 30 may be less efficient than the washing or rinsing effect gained by rotating the pulsator 35.

The washing or rinsing for the laundry loaded in the tub-drum 50 may be performed by rotating the drum 30. In other words, the sub-drum 50 may perform the washing or rinsing while being rotated together with the drum 30 by using the rotational force of the drum 30. The pulsator 35 may not be connected with the sub-drum 50.

When the drum 30 is rotated in the clockwise and counter-clockwise direction to perform the washing or rinsing by rotating the sub-drum 50, not only the friction between the drum 30 and the wash water held in the tub 20 but also the friction between the inner surface of the sub-drum 50 and the laundry held in the sub-drum 50 may be generated, and some additional force that is as strong as the weight of the wash water held in the sub-drum may be applied to the motor such that some load may be applied to the drive unit 14.

When the load is applied to the drive unit 14, the temperature of the drive unit 14 might rise drastically and the drastically rising temperature might cause an error of the drive unit 14.

The rising temperature of the drive unit 14 might occur frequently when the drum 30 or the pulsator 35 is rotated for a long time period or the drum 30 and the pulsator 35 are rotated several times. Especially, the more load is generated by the drum and the sub-drum, the more frequently the load may be applied to the drive unit.

Accordingly, the control method of the laundry treating apparatus 1 in accordance with an embodiment provides following steps.

The control method of the laundry treating apparatus 1 may comprise a water current forming step (SS722, S725 and S750) and a cooling step (S723, DS724, S730 and S740).

The water current forming step (SS722, S725 and S750) may be defined as the step configured to repeatedly rotate the drum 30 and the pulsator 35 so as to perform the washing or rinsing by forming a water current in the wash water supplied to the drum 30 and the wash water supplied to the sub-drum 50. Accordingly, the basket motion or the pulsate motion may be performed in the water current forming step (SS722, S725 and S750). In the water current forming step (SS722, S725 and S750), the basket motion and the pulsate motion may be performed sequentially or repeatedly such that the temperature of the drive unit 14 may rise in the water current forming step (SS722, S725 and S750). The water current forming step (SS722, S725 and S750) may comprise a first water current forming step (S722), a second water current forming step (S725) and a third water current forming step (S750). The first water current forming step (S722) and the second water current forming step (S725) may be performed before the additional water supply to the tub is completed. The third water current forming step (S750) may be performed after the additional water supply is completed. The motions performed in each of the water current forming steps (S722, S725 and S750) may be the same or different.

The first water current forming step (S722) may be repeated to form water current in the wash water supplied to the drum 30 and the wash water supplied to the sub-drum 50 by the rotational force transmitted from the drive unit 14 to rotate the drum 30 and the sub-drum 50 simultaneously, as the basket motion is performed. In the water current forming step, the basket motion may be consistently performed or dominantly. In other words, the first water current forming step (S722) may be configured to control the drive unit 14 to transmit the rotational force to the drum 30 and the sub-drum 50 after wash water is supplied to the laundry loaded in the tub 20 and the laundry loaded in the sub-drum 50. During the first water current forming step (S722), the drum 30 may repeat the clockwise-direction rotation. In the pausing or temporarily stopping for changing the rotation direction, load may be applied to the drive unit. In the stop motion, no load may be applied to the drive unit.

More specifically, the first water current forming step (S722) may be performed to control the drive unit 14 to repeatedly rotate the drum 30 and the sub-drum 50 in the clockwise and counter-clockwise direction. At this time, the friction between the surface of the drum 30 and the wash water held in the tub 20, the weight of the laundry loaded in the drum 30 and the sub-drum 50 and the friction between the inner surface of the sub-drum 50 and the wash water held in the sub-drum 50 may act as the resistance against the clockwise-direction and counter-clockwise direction rotation of the drum 30.

Compared with other steps which will be described later, the first water current forming step (S722) may cause the largest load applied to the drive unit 14 and the most drastic rise of the temperature in the drive unit 14. Accordingly, the first water current forming step (S722) may not be performed over a preset time period so as to prevent the error generated by the drastic temperature rise of the drive unit 14. The preset time period may be set as approximately 1 minute, for example, not limited thereto. The time period may be set differently according to the capacities of the drum 30, the sub-drum 50 and the performance of the drive unit 14 and the like. After the first water current forming step (S722), the second water current forming step (S725) and the cooling step (S723, S724, S730 and S740) which will be described later may be performed.

The second water current forming step (S725) may be the step in which the pulsate motion is performed, in other words, configured to form the water current in the wash water held in the drum 30 by the repeated clockwise and counter-clockwise rotation of the pulsator 35 generated by the rotational force of the drive unit 14.

In other words, the second water current forming step (S725) may be configured to control the drive unit 14 to transmit the rotational force to the pulsator 35 after wash water is supplied to the tub 20 and the sub-drum 50. In such the second water current forming step (S725), the pulsate motion may be performed consistently or dominantly.

In the second water current forming step (S725), the friction between the surface of the pulsator 35 and the laundry and wash water loaded in the drum 30 may act as the resistances against the clockwise and counter-clockwise rotation of the pulsator 35. Accordingly, the second water current forming step (S725) may apply a smaller load to the drive unit 14 than the first water current forming step (S722) and may raise the temperature of the drive unit 14 less drastically, in other words, at a lower temperature rise rate than the first water current forming step (S722).

Meanwhile, as it is performed after the first water current forming step (S722) in case the temperature of the drive unit 14 rises too high in the first water current forming step (S722), the second water current forming step (S725) may be configured to lower the temperature of the drive 14 a little bit. Accordingly, when the first water current forming step (S722) is performed continuously, much load is applied to the drive unit 14 and the temperature of the drive unit rises. However, when the first water current forming step (S722) and the second water current forming step (S725) are repeatedly performed, the drastic rise of the temperature in the drive unit 14 may be suppressed.

As mentioned above, the washing or rinsing for the laundry loaded in the sub-drum may be intensively performed during the first water current forming step. The washing or rinsing for the laundry loaded in the drum may be intensively performed during the second water current forming step. However, there may be a big difference between the loads applied to the drive unit in the first and second water current forming steps. Considering that, it may be preferred in the embodiment that the first water current forming step and the second water current forming step are performed repeatedly during the entire wash cycle or the rinse cycle. In other words, the performance timing of the first water current forming step may be dispersed and the performance timing of the second water current forming step may be dispersed in the entire wash or rinse cycle.

As one example, it may be excluded that only the first water current forming step is performed in the first half of the wash cycle (before the completion of the additional water supply) and that only the second water current forming step is performed in the second half (after the additional water supply). It may also be excluded to perform only the second water current forming step in the first half and only the first water current forming step in the second half. In other words, the performance timing and repeated pattern of the first and second water current forming steps may be preset in the wash or rinse cycle.

The maximum time taken to perform one first water current forming step may be shorter than the maximum time taken to perform on second water current forming step. The frequency of the first water current forming step performed in one wash or rinse cycle may be smaller than that of the second water current forming step. The total time of the first water current forming step performance in one wash or rinse cycle may be shorter than the total time of the second water current forming step performance. In one cycle, the performance frequency of the same water current forming steps, the duration time of one water current forming step and the total performance time of the same water current forming steps may be preset.

When only the basket motion is performed in the first water current forming step, the performance timing, frequency and time of the first water current forming step may be equal to those of the basket motion. When only the pulsate motion is performed in the second water current forming step, the performance timing, frequency and time of the second water current forming step may be equal to those of the pulsate motion.

Substantially, the wash or rinse cycle may be performed in the water current forming steps mentioned above. Considering the overload of the drive unit and the washing/rinsing effect for the entire laundry loaded in the drum and the sub-drum, the steps in which the other motions are performed may be realized combinedly.

The cooling step (S723, S724, S730 and S740) may be configured not to rotate at least one of the drum 30 and the pulsator 35 so as to lower the raised temperature of the drive unit 14 during the water current forming steps (S722 and S725). More specifically, the cooling step may perform the predetermined motion applying less load than the basket motion or the pulsate motion during the water current forming step or between the water current forming steps.

The cooling step may be configured to secure the time for emitting heat for a preset time period. When the basket motion or the pulsate motion is performed for a predetermined time period, a preset cooling step may be performed.

The cooling step may be performed once the water current forming step (S722, S725 and S750) starts. After all of the water current forming steps (S722, S725 and S750) are completed in the wash or rinse cycle, the drainage or dry-spinning may be performed in which the drum 30 and the sub-drum 50 drains the wash water while being rotated. However, the load applied to the drive unit 14 in the drainage and dry-spinning may be less than the load applied to the drive unit 14 in the water current forming step (S722, S725 and S750). Accordingly, after the water current forming step (S722 and S725) is completed, the drive unit may be cooled only by the performance of the drainage and the dry-spinning.

More specifically, the basket motion may be performed in the first water current forming step and only the basket motion may be performed in the entire sections of the first water current forming step. Alternatively, the cooling step may be performed between the basket motion and the basket motion in the first water current forming step. In this instance, the maximum duration time of the basket motion may be preset.

Likewise, the pulsate motion may be performed in the second water current forming step and only the pulsate motion may be performed in the entire sections of the second water current forming step. Of course, the cooling step may be performed between the pulsate motion and the pulsate motion in the second water current forming step. In this instance, the maximum duration time of the basket motion may be equal to or shorter than that of the pulsate motion.

The cooling step may comprise an additional water supply step (S723 and S724), a laundry disentangling step (S730), and a pause step (S740).

The additional water supply step (S723 and S724) may comprise a step for measuring a water level of the tub 20 in a state where the rotations of the drum 30 and the pulsator 35 are stopped, and a step for supplying wash water to the tub 20 when the measured water level of the tub 20 is lower than a preset water level.

As the stop motion is performed in the step for measuring the water level of the tub 20, the drum 30 and the pulsator 35 may not be rotated to form the water current in the wash water held in the tub 20 so as to measure the water level of the tub precisely. Accordingly, heat may be radiated from the drive unit 14 while the drive unit 14 is not operated.

The step for supplying wash water to the tub 20 may supply additional wash water to the tub 20 from the water supply unit 18, when the water level measured in the step for measuring the water level of the tub 20 is lower than a reference value. Accordingly, the stop motion may be performed during the additional water supply. When the angle control of the sub-drum is needed for the additional water supply, the angle control motion may be performed to set a water supply location for the additional wash water supply to the tub 20. At this time, the drum 30 may be rotated at approximately 3 rpm or 15~25 rpm. The rotation speed of the drum 3 may be quite low such that the heat amount of the drive unit 14 may be quite little. Accordingly, in case the temperature of the drive unit 14 rises severely, the temperature of the drive unit 14 may be lowered by the low speed rotation of the drum 30. Once the angle control motion is completed, the additional water supply may be performed during the stop motion. The temperature of the drive unit may be lowered while it is determined whether to perform the additional water supply and while the additional water supply is performed. Alternatively, the temperature of the drive unit may be lowered while the additional water supply is prepared.

However, it is typical to perform the additional water supply in an early stage of the wash cycle. In other words, the additional water supply may supply the optimal amount of the wash water to perform the washing effectively. The additional water supply may lower the temperature of the drive unit and it is not preferred that the additional water supply is performed in a late stage of the washing in which the main or real washing is performed. Accordingly, the washing may be divided into an initial washing and a latter washing with respect to the final performance timing of the additional water supply. The decrease of the temperature of the drive unit facilitated by the additional water supply may be performed only in the initial washing.

The laundry disentangling step (S730) may be the step in which the balance motion is performed. The laundry disentangling step may be configured to rotate the pulsator 35 at a very low speed in a clockwise-direction and a counter-clockwise direction to distribute the laundry, which may be entangled by the rotation of the pulsator in the washing or rinsing, in the drum 30 uniformly. Such the laundry disentangling step may be performed after the additional water supply finally, in other words, in the latter washing. The cooling facilitated by the additional water supply may not be performed in the latter washing. It may be preferred that the laundry disentangling step is performed for the cooling after the additional water supply is finally performed or the basket motion or the pulsate motion is performed.

The rotation speed of the pulsator in the laundry disentangling step (S730) may be lower than that of the pulsator in the second water current forming step (S725). The amount of the heat generated in the drive unit 14 may be smaller in the laundry disentangling step (S730) than in the second water current forming step (S725). Accordingly, in case the temperature of the drive unit 14 rises drastically in the second water current forming step (S725), the laundry disentangling step (S730) may be performed and the temperature of the drive unit 14 may be lowered.

The pause step (S740) may be configured not to rotate the drum 30 and the pulsator 35 by stopping the operation of the drive unit 14 as the stop motion is performed or configured to rotate the drum 30 at a very low rotation speed as a low speed rotation motion is performed. The pause step (S740) may have the largest effect of the drive unit temperature lowering. To prevent the user from misunderstanding that the laundry treating apparatus is operated abnormally, the pause step (S740) may rotate the drum 30 at a very low speed to allow the user to identify whether the washing course is performed.

In the latter washing, the cooling facilitated by the additional water supply may not be performed such that it may be preferred to perform the pause step to perform the cooling after the washing. The duration time and total performance time of the water current forming step may be longer than in the latter washing than in the initial washing, because the main washing may be performed in the latter washing. Accordingly, the water current forming step, the laundry disentangling step and the pause step may be performed serially in the latter washing. Such a serial performance pattern may be performed several times in the latter washing.

The control method of the laundry treating apparatus in accordance with the embodiment may perform the steps shown in FIG. 7 according to a preset pattern.

First of all, the sub-drum 50 may be coupled to the inner circumferential surface of the drum 30 and then the water supply step (S710) may be performed to supply wash water to the tub 20 and the sub-drum 50.

The water supply step (S710) may be configured to adjust the amount of the wash water supplied to the tub 20 by using a water level sensor for measuring the water level of the tub 20 and adjust the amount of the wash water supplied to the sub-drum 50 by measuring the water flow and the time.

Hence, the first water current forming step (S722) may be performed to rotate the drum 30 so as to perform the washing or rinsing for the laundry loaded in the sub-drum 50. Of course, the second water current forming step (S725) configured to perform the pulsate motion may be performed prior to the first water current forming step.

Meanwhile, the water current might be generated even in the wash water held in the drum 30 by the friction between the inner circumferential surface of the drum 30 and the wash water held in the tub 20, such that the first water current forming step (S722) may be the step configured to perform the washing or rinsing for the laundry loaded in the drum 30 as well as the sub-drum 50.

As the drive unit 14 drives the drum 30 in the clockwise and counter-clockwise direction, the first water current forming step (S722) may apply a large amount of load to the drive unit 14 and the temperature of the drive unit 14 may rise drastically. Accordingly, the first water current forming step (S722) may not be performed over a preset time period. Such a preset time period may be approximately 1 minute as mentioned above.

The laundry loaded in the drum 30 may continuously absorb wash water even in first water current forming step (S722) as well as the water supply step (S710) according to fabric types of the laundry. Only the amount of the wash water measured by the water level sensor in the water supply step (S710) might secure a sufficient washing performance such that additional wash water may be supplied by measuring the water level.

More specifically, the additional water supply step (S723 and S724) may be performed and include the step (S723) for determining whether the water level of the tub 20 is lower than a reference level after the first water current forming step (S722) is performed, and the step (S724) for additionally supplying wash water to the tub 20, when the measured water level is lower than the reference level.

The additional water supply step (S723 and S724) may not operate the drive unit so as to measure the water level and rotate the drum 30 at the very low speed to set the water supply location such that the temperature of the drive unit 14 can be lowered.

Meanwhile, when the measured water level is the reference level or more (S723-N) or after additional wash water is supplied in the additional water supply step (S723 and S724), the second water current forming step (S725) may be performed.

The second current forming step (S725) may rotate the pulsator 35 to perform the washing or rinsing for the laundry loaded in the drum 30. The temperature of the drive unit 14 lowered by the performance of the additional water supply step (S723 and S724) may rise again in the second water current forming step (S725.

As shown in FIG. 7, the process or pattern of sequentially performing the first water current forming step (S722), the additional water supply step (S723 and S724) and the second water current forming step (S725) may be repeatedly performed several times. In other words, after '0' is stored in 'n' initially, the second water current forming step (S725) may be performed and '1' may be added to 'n' (S726). Hence, unless such 'n' reaches a reference (S727-N), the first current forming step (S722) may be performed again. When 'n' reaches the reference value (S727-Y), the step may be performed. in this instance, the reference valve may be preset based on the fabric types of the laundry, the amount of the laundry, the amount of the wash water, the temperature of the wash water and the like, and then preset reference value may be stored.

It may not be preferred to get to the first water current forming step from the second water current forming step immediately. Accordingly, it may be preferred to perform the first water current forming step once the pause step is performed after the second water current forming step.

Once the second water current forming step is performed after the final additional water supply, the laundry disentangling step may be performed. The laundry disentangling step (S730) may usually be performed after the pattern configured to sequentially perform the first water current forming step (S722), the additional water supply step (S723 and S724) and the second water current forming step (S725) is repeated several times. In other words, the laundry disentangling step (S730) may be performed after the laundry is entangled and the additional water supply is completed. The laundry disentangling step (S730) may be configured to disentangle the laundry, which may be entangled in a state where wash water is insufficient, after the final water supply. It can be known that the initial washing ends and the latter washing starts through the laundry disentangling step.

Such the laundry disentangling step (S730) may repeatedly rotate the pulsator 35 at the low speed in the clockwise and counter-clockwise direction such that the temperature of the drive unit 14 raised by the performance of the above-noted pattern can be lowered.

The pause step (S740) may be performed after the laundry disentangling step (S730). Moreover, the pause step (S740) can lower the temperature of the drive unit 14 most effectively and be performed before the first water current forming step (S722). The first water current forming step (S722) may be performed after the temperature of the drive unit is lowered sufficiently by the performance of the pause step (S740). In this instance, the temperature of the drive unit 14 may not reach a high temperature which may result in the error of the drive unit 14, even with the largest increase of the temperature in the first water current forming step (S722).

Meanwhile, the first water current forming step (S750) may be performed after the pause step (S740). The third water current forming step may perform the basket motion and the pulsate motion sequentially. After the third water current forming step (S270) ends, the laundry disentangling step and the pause step may be performed. Again, the third water current forming step may be performed after the pause step. The third water current forming step, the laundry disentangling step and the pause step may be repeatedly performed. The basket motion may be performed in the final third water current forming step and the drainage step and the dry-spinning step may be performed after the basket motion.

In the drainage step, all of the wash water may be drained from the tub 20 and the sub-drum 50. Accordingly, even if the drive unit 14 rotates the drum 30 and the pulsator 35 at a high speed in the dry-spinning step, the load applied to the drive unit in the first water current forming step (S722) may be less than the load applied to the drive unit 14 in the second water current forming step (S725).

The temperature of the drive unit 14 raised in the third water current forming step (S750) during the drainage and dry-spinning step (S760) may be lowered. After the final third water current forming step (S750), no auxiliary cooling step may be performed and then the drainage and dry-spinning step (S760) may be performed.

If the flow shown in FIG. 7 is the wash cycle, the drainage and dry-spinning step (S760) may be a dry-intermediate spinning which is performed before the rinse cycle. If the flow shown in FIG. 7 is the rinse cycle, the drainage and dry-spinning may be the intermediate dry-spinning or the final dry-spinning (or the main dry-spinning). The rinse cycle may be performed two times or more and the final dry-spinning may be performed after the final rinse cycle.

Referring to FIG. 7, the embodiment of the control method is described in detail, in terms of the wash (rinse) cycle configured of the step (the water current forming step) configured to perform the washing (rinsing), the water supply step, the laundry disentangling step, and the pause step.

Hereinafter, referring to FIGS. 8 and 9, an embodiment of the control method will be described in detail, in terms of the drum motions performed in the wash cycle. This embodiment of the control method may be equal or similar to the embodiment of the control method shown in FIG. 7.

Figure 8:
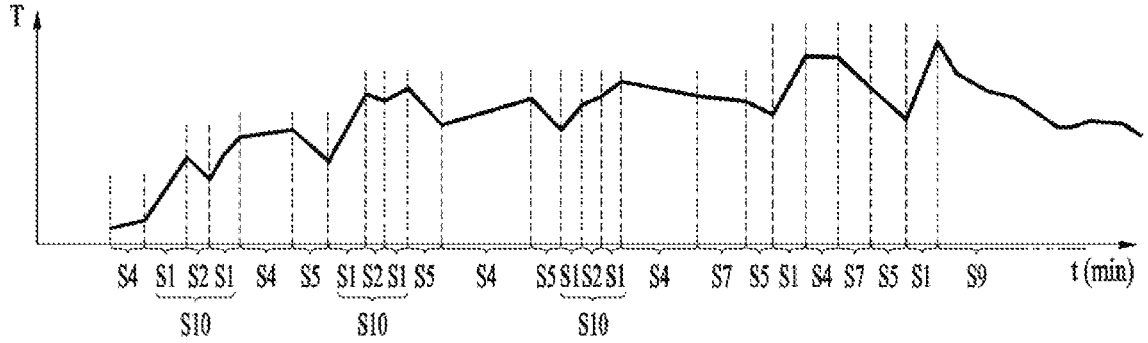
FIG. 8 is a graph schematically illustrating temperature variation of the drive unit when a control method of the laundry treating apparatus is applied in accordance with an embodiment of the present disclosure.
Figure 9:
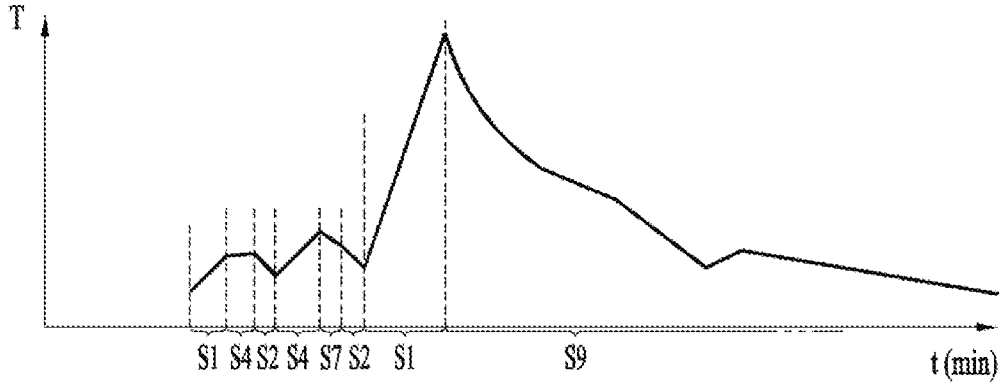
FIG. 9 is another graph schematically illustrating temperature variation of the drive unit when a control method of the laundry treating apparatus is applied in accordance with an embodiment of the present disclosure.

The order of the motions performed during the wash or rinse cycle and temperature variation of the drive unit 14 are shown in FIGS. 8 and 9.

In FIGS. 8 and 9, the first water current forming step (S722) or the basket motion may be referred to as 'S1' and the second water current forming step (S725) or the pulsate motion may be referred to as 'S4'. The additional water supply (S723 and S724) or the stop motion (the angle control motion) may be referred to as 'S2' and the laundry disentangling step (S730) or the balance motion may be referred to as 'S7'. The pause step (S740) or the stop motion may be referred to as 'S5' and the drainage and dry-spinning step (S760) may be referred to as 'S9'.

After the initial water supply, the pulsate motion (S4) may be performed initially. The preset pattern (S10) configured to sequentially perform the basket motion (S1), the additional water supply (S2) and the basket motion (S1) may be performed several times, which is referred to as 'S10'.

The entire S10 may be the first water current forming step. It can be said that the additional water supply step is performed between the first water current forming step and the first water current forming step. In the former case, it can be said that the additional water supply is performed during the first water current forming step by default. In the latter case, it can be said that the additional water supply is performed between the first water current forming step and the first water current forming step by default.

Accordingly, the temperature of the drive unit 14 may rise in the basket motion (S1) and the temperature of the drive unit 14 may be lowered or the increase of the temperature may become dull in the additional water supply step (S2). Meanwhile, the second water current forming step or the pulsate motion and the pause step (S5) may be performed between the pattern (S10).

The above-noted pattern (S10) may be repeated three times and may end as shown in FIG. 8. After that, the second water current forming step (S4) may be performed. As the above-noted pattern (S10) is repeated three times, the temperature of the drive unit may be raised. Even when the second water current forming step (S4) is performed, the temperature of the drive unit 14 may be lowered.

Hence, the laundry disentangling step (S7) and the pause step (S5) may be sequentially performed.

Once the laundry disentangling step (S7) and the pause step (S5) are performed, the basket motion (S1) and the pulsate motion (S4) may be performed sequentially and the temperature of the drive unit may rise.

Hence, the laundry disentangling step (S7) and the pause step (S5) may be sequentially performed. As the pause step (S5) is performed after the laundry disentangling step (S7), the temperature of the drive unit 14 may be sufficiently lowered.

Then, the basket motion (S1) may be performed finally and the drainage step and the dry-spinning step may be performed. As the drainage step and the dry-spinning step are performed, the temperature of the drive unit 14 raised in the basket motion (S1) may be lowered.

Referring to FIG. 9, the process of the rinse cycle is illustrated. The basket motion (S1) may be initially performed and the pulsate motion (S4), the additional water supply (S2) and the basket motion (S1) may be performed again.

Hence, the balance motion (S7) configured to disentangle the laundry may be performed and the additional water supply step (S2) may then be performed, only to lower the temperature of the dive unit 14 sufficiently and then perform the first water current forming step (S1).

Different from the wash cycle, the rinse cycle may not perform the pause step configured to perform the stop motion (S5). The rinse cycle may be shorter than the wash cycle such that the temperature increase of the drive unit 14 may be relatively small and the overall duration time of the basket motion and the pulsate motion may be relatively short.

The foregoing embodiments are merely exemplary and are not to be considered as limiting the present disclosure. The present teachings can be readily applied to other types of methods and apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments. As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds, are therefore intended to be embraced by the appended claims.

INDUSTRIAL APPLICABILITIES

Industrial applicability of the present disclosure is included in the description of the specific embodiments.

What is claimed is:

1. A method of controlling a laundry treating apparatus comprising a tub configured to hold wash water, a drum rotatably mounted in the tub, a pulsator rotatably mounted in the drum, a sub-drum detachably coupled to an inner circumferential surface of the drum, the sub-drum configured to hold wash water, and a driver configured to rotate the drum and the pulsator, the method comprising:

a water supply step of supplying washing water to the tub and the sub-drum;

a water current forming step comprising performing a plurality of basket motions and a plurality of pulsate motions in a wash cycle and a rinse cycle, either sequentially or alternately, wherein:

each basket motion is configured to form water current in the wash water held in the tub and the wash water held in the sub-drum simultaneously, as the drum and the sub-drum are driven together, and each pulsate motion is configured to form water current in wash water held in the drum while the pulsator is driven;

a driver cooling step performed after at least one basket motion of the water current forming step to lower the temperature of the driver, the driver cooling step comprising a laundry disentangling step comprising performing a balance motion to repeatedly rotate the pulsator in a clockwise direction and a counter-clockwise direction to disperse laundry in the drum; and an additional water supply step comprising determining whether to supply additional wash water to the tub and selectively supplying the additional wash water and controlling the rotation of the drum to move the sub-drum to a preset location to locate a water supply guide of the sub-drum under a water supply unit of the laundry treating apparatus in order to guide the additional wash water to the tub, wherein an execution time of the driver cooling step is preset in at least one of the wash cycle or the rinse cycle, wherein, in the driver cooling step, the driver is controlled with less load than a load in the basket motions and the pulsate motions, and wherein, in the laundry disentangling step, the pulsator is rotated in the clockwise direction and the counter-clockwise direction to distribute the laundry at speed lower than the rotational speed of the pulsate motion.

2. The method of controlling the laundry treating apparatus of claim 1, wherein in the water current forming step, a total time of the plurality of pulsate motions is longer than a total time of the plurality of basket motions.

3. The method of controlling the laundry treating apparatus of claim 1, wherein a duration of the water current forming step is longer than the duration of the driver cooling step.

4. The method of controlling the laundry treating apparatus of claim 1, wherein in the water current forming step, execution frequencies of the basket motions are larger than execution frequencies of the pulsate motions.

5. The method of controlling the laundry treating apparatus of claim 1, wherein in the water current forming step, a maximum time of the basket motions is equal to or smaller than a maximum time of the pulsate motions.

6. The method of controlling the laundry treating apparatus of claim 1, further comprising stopping a rotation of the drum and the pulsator in the additional water supply step when the sub-drum reaches the preset location.

7. The method of controlling the laundry treating apparatus of claim 1, wherein the additional water supply step is performed between one of the basket motions and one of the pulsate motions, between one of the basket motions and another of the basket motions, or between one of the pulsate motions and another of the pulsate motions.

8. The method of controlling the laundry treating apparatus of claim 1, wherein the cooling step further comprises a pause step, wherein the pause step comprises at least one of stopping a rotation of the driver and repeatedly rotating the driver in a clockwise direction and a counter-clockwise direction at a lower rpm than an rpm of the driver in the basket motions.

9. The method of controlling the laundry treating apparatus of claim 1, wherein the laundry disentangling step is performed between one of the pulsate motions and a pause step.

10. The method of controlling the laundry treating apparatus of claim 8, wherein the pause step is performed between one of the basket motions and one of the pulsate motions.

11. The method of controlling the laundry treating apparatus of claim 1, wherein:

the wash cycle comprises an initial washing cycle and a latter washing cycle, wherein a timing of the initial washing cycle and a timing of the latter washing cycle are relative to a time at which the wash water is supplied to the tub, and the laundry disentangling step is performed in the latter washing cycle.

12. The method of controlling the laundry treating apparatus of claim 1, wherein:

the wash cycle comprises an initial washing cycle and a latter washing cycle, wherein a timing of the initial washing cycle and a timing of the latter washing cycle are relative to a time at which the wash water is supplied to the tub, a frequency and a performance time of the basket motions performed in the initial washing cycle are greater than a frequency and a performance time of the basket motions performed in the latter washing cycle.

13. The method of controlling the laundry treating apparatus of claim 1, wherein the basket motions are performed serially after the pulsate motions are performed.

14. The method of controlling the laundry treating apparatus of claim 1, wherein, when the pulsate motions are performed serially after the basket motions, the driver cooling step is preset to be performed after the pulsate motions.

15. The method of controlling the laundry treating apparatus of claim 1, wherein the water current forming step is completed by a final basket motion of the basket motions, and drainage is performed by driving a drainage pump while the drum and the pulsator are stopped.

* * * * *